US011166520B2

(12) United States Patent
Hatfield et al.

(10) Patent No.: US 11,166,520 B2
(45) Date of Patent: Nov. 9, 2021

(54) FOOTWEAR WITH INTERCHANGEABLE BOOTIE SYSTEM

(71) Applicant: NIKE, Inc., Beaverton, OR (US)

(72) Inventors: Tinker L. Hatfield, Portland, OR (US); Joshua P. Heard, Happy Valley, OR (US); Robert M. Bruce, Portland, OR (US); Tom Luedecke, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 335 days.

(21) Appl. No.: 15/180,502

(22) Filed: Jun. 13, 2016

(65) Prior Publication Data

US 2016/0353830 A1 Dec. 8, 2016

Related U.S. Application Data

(62) Division of application No. 13/198,482, filed on Aug. 4, 2011, now Pat. No. 9,392,836.

(51) Int. Cl.
*A43B 3/24* (2006.01)
*A43B 7/14* (2006.01)
(Continued)

(52) U.S. Cl.
CPC ..... *A43B 3/24* (2013.01); *A43B 3/242* (2013.01); *A43B 5/002* (2013.01); *A43B 5/02* (2013.01);
(Continued)

(58) Field of Classification Search
CPC ..... A43B 7/20; A43B 7/148; A43B 7/1475; A43B 7/1425; A43B 7/1445; A43B 7/144;
(Continued)

(56) References Cited

U.S. PATENT DOCUMENTS 2,422,410 A 6/1947 Gross
3,683,519 A 8/1972 Adelene
(Continued)

FOREIGN PATENT DOCUMENTS

CN 201278857 Y 7/2009
CN 201379124 Y 1/2010
(Continued)

OTHER PUBLICATIONS

Extended European Search Report dated Jun. 26, 2014 for European Application No. 14165538.1 filed Jul. 31, 2012.
(Continued)

*Primary Examiner* — Katharine G Kane
(74) *Attorney, Agent, or Firm* — Banner & Witcoff, Ltd.

(57) ABSTRACT

An interchangeable bootie system includes an article of footwear and a plurality of interchangeable booties. Each bootie includes a support system configured to provide targeted support to different regions of the foot. This allows a user to select a bootie that provides the desired type of support for an athletic activity. An interchangeable bootie system with midsole portions having different types of cushioning systems is also disclosed. This allows a user to select a bootie with the desired type of support and the desired type of cushioning for an athletic activity. An interchangeable bootie and midsole insert system is also disclosed. Each midsole insert fits inside a bootie and includes a cushioning system configured to provide targeted cushioning to different regions of the foot. This allows a user to select a desired type of cushioning for an athletic activity.

27 Claims, 21 Drawing Sheets

(51) Int. Cl.

| | |
|---|---|
| ***A43B 19/00*** | (2006.01) |
| ***A43B 7/20*** | (2006.01) |
| ***A43B 13/18*** | (2006.01) |
| ***A43B 5/00*** | (2006.01) |
| ***A43B 5/02*** | (2006.01) |
| *A43B 3/10* | (2006.01) |

(52) U.S. Cl.
CPC ..... *A43B 7/144* (2013.01); *A43B 7/1425* (2013.01); *A43B 7/1445* (2013.01); *A43B 7/1475* (2013.01); *A43B 7/20* (2013.01); *A43B 13/186* (2013.01); *A43B 13/188* (2013.01); *A43B 13/189* (2013.01); *A43B 19/00* (2013.01); *A43B 3/10* (2013.01)

(58) Field of Classification Search
CPC ..... A43B 7/149; A43B 7/22; A43B 17/00; A43B 13/186; A43B 19/00; A43C 1/00; A43C 11/00
USPC ..... 36/83, 89, 91, 92, 100, 10, 55, 43, 44, 36/160
See application file for complete search history.

(56) References Cited

U.S. PATENT DOCUMENTS

| | | | | |
|---|---|---|---|---|
| 4,005,533 | A | 2/1977 | Anderson et al. | |
| 4,180,923 | A | 1/1980 | Dassler | |
| 4,183,156 | A | 1/1980 | Rudy | |
| 4,219,945 | A | 9/1980 | Rudy et al. | |
| 4,736,531 | A | 4/1988 | Richard | |
| 5,092,347 | A | 3/1992 | Shaffer et al. | |
| 5,499,459 | A | 3/1996 | Tomaro | |
| 5,543,194 | A | 8/1996 | Rudy | |
| 5,608,976 | A | 3/1997 | Marega et al. | |
| 5,713,141 | A | 2/1998 | Mitchell et al. | |
| 5,787,608 | A * | 8/1998 | Greenawalt | A43B 3/128 36/11.5 |
| 5,901,394 | A * | 5/1999 | Greenawalt | A43B 3/128 12/142 N |
| 5,952,065 | A | 9/1999 | Mitchell et al. | |
| 5,964,047 | A | 10/1999 | Covatch | |
| 5,970,629 | A | 10/1999 | Tucker et al. | |
| 6,013,340 | A | 1/2000 | Bonk et al. | |
| 6,082,025 | A | 7/2000 | Bonk et al. | |
| 6,127,026 | A | 10/2000 | Bonk et al. | |
| 6,203,868 | B1 | 3/2001 | Bonk et al. | |
| 6,321,465 | B1 | 11/2001 | Bonk et al. | |
| 6,606,804 | B2 * | 8/2003 | Kaneko | A43B 7/1495 36/50.1 |
| 7,010,872 | B2 * | 3/2006 | Pawlus | A43B 3/0047 36/100 |
| 7,131,218 | B2 | 11/2006 | Schindler et al. | |
| 7,210,249 | B2 | 5/2007 | Passke et al. | |
| 7,370,438 | B2 | 5/2008 | Vattes et al. | |
| 7,386,947 | B2 | 6/2008 | Martin et al. | |
| 7,409,779 | B2 | 8/2008 | Dojan et al. | |
| 7,475,500 | B2 | 1/2009 | Covatch | |
| 7,578,076 | B2 | 8/2009 | Pawlus et al. | |
| 7,588,654 | B2 | 9/2009 | Schindler et al. | |
| 7,591,919 | B2 | 9/2009 | Schindler et al. | |
| 7,631,440 | B2 | 12/2009 | Keen et al. | |
| 7,836,612 | B2 | 11/2010 | Agnew et al. | |
| 2003/0093919 | A1 | 5/2003 | Wang | |
| 2004/0128863 | A1 | 7/2004 | Hong et al. | |
| 2004/0244221 | A1 | 12/2004 | Hall et al. | |
| 2005/0268490 | A1 * | 12/2005 | Foxen | A43B 7/1425 36/28 |
| 2006/0117606 | A1 | 6/2006 | Chen et al. | |
| 2007/0062067 | A1 | 3/2007 | Covatch | |
| 2007/0137067 | A1 * | 6/2007 | Fallon | A43B 3/24 36/100 |
| 2007/0271822 | A1 | 11/2007 | Meschter | |
| 2007/0271823 | A1 | 11/2007 | Meschter | |
| 2008/0005933 | A1 * | 1/2008 | Auger | A43B 7/20 36/97 |
| 2008/0134543 | A1 | 6/2008 | Klein | |
| 2008/0141562 | A1 * | 6/2008 | Peveto | A43B 7/142 36/91 |
| 2008/0229614 | A1 | 9/2008 | Santa | |
| 2009/0100713 | A1 | 4/2009 | Adami et al. | |
| 2009/0288312 | A1 | 11/2009 | Dua | |
| 2009/0288313 | A1 | 11/2009 | Rapaport et al. | |
| 2010/0186255 | A1 | 7/2010 | Avar et al. | |
| 2010/0263236 | A1 | 10/2010 | Carboy et al. | |
| 2011/0023325 | A1 | 2/2011 | Wines et al. | |
| 2011/0131831 | A1 | 6/2011 | Peyton et al. | |
| 2012/0011744 | A1 * | 1/2012 | Bell | A43B 7/14 36/50.1 |

FOREIGN PATENT DOCUMENTS

| | | | |
|---|---|---|---|
| CN | 101909471 | A | 12/2010 |
| CN | 103747698 | A | 4/2014 |
| DE | 19904852 | A1 | 8/2000 |
| DE | 102006041673 | A1 | 8/2007 |
| DE | 102008001871 | A1 | 11/2009 |
| WO | 0133987 | A1 | 5/2001 |
| WO | 2004043184 | A1 | 5/2004 |
| WO | 2005031150 | A1 | 4/2005 |
| WO | 2009055369 | A1 | 4/2009 |
| WO | 2012166869 | A1 | 12/2012 |

OTHER PUBLICATIONS

First Office Action dated Jun. 3, 2015 for Chinese Patent Application No. 201280049069.2 filed Jul. 31, 2012.
International Preliminary Report on Patentability (including Written Opinion of the ISA) for Application No. PCT/US2012/048960 dated Feb. 13, 2014.
International Search Report and Written Opinion for Application No. PCT/US2012/048960, dated Jan. 7, 2013.
Response to Office Action dated Jun. 3, 2015 for Chinese Application No. 201280049069.2filed Jul. 31, 201.
Response to Second Office Action for Chinese Patent Application No. 201280049069.2 dated Feb. 3, 2016, 40 pages.
Second Office Action dated Feb. 3, 2016 for Chinese Patent Application No. 201280049069.2 filed Jul. 31, 2012.
Jun. 26, 2014—(EP) Written Opinion—App. No. 14165538.1.
Sep. 6, 2019—(EP) ESR—App. No. 19186423.0.

* cited by examiner

FOOTWEAR WITH INTERCHANGEABLE BOOTIE SYSTEM

CROSS-REFERENCE TO RELATED APPLICATIONS

This application is a divisional of Hatfield, U.S. Patent Application Publication No. 2013/0031801, published on Feb. 7, 2013 and entitled "Footwear with Interchangeable Bootie System," the entire disclosure of which is incorporated herein by reference.

BACKGROUND

The present embodiments relate generally to articles of footwear, and in particular to articles of footwear with interchangeable booties.

Articles of footwear generally include an upper and a sole. The sole can further include a midsole and/or outsole. The upper helps to keep the sole fastened to the foot and generally provides protection for the foot. The sole can provide various kinds of support, cushioning and shock absorption.

SUMMARY

In one aspect, a kit of parts includes an article of footwear, a first bootie, where the first bootie is configured to be inserted into the article of footwear and a second bootie, where the second bootie is configured to be inserted into the article of footwear. The first bootie configured to provide support to a first portion of the article of footwear and the second bootie is configured to provide support to a second portion of the article of footwear. The first portion is different than the second portion.

In another aspect, an interchangeable bootie system includes an article of footwear and a group of booties. Each of the booties is configured to be received in the article of footwear. Each bootie of the group of booties provides support for a different region of a foot so that the booties may be interchanged with one another to accommodate different athletic activities.

In another aspect, a kit of parts includes an article of footwear, a first bootie, where the first bootie is configured to be inserted into the article of footwear and a second bootie, where the second bootie is configured to be inserted into the article of footwear. The first bootie includes a first support system and the second bootie includes a second support system. The first support system is different from the second support system.

In another aspect, a kit of parts includes an article of footwear, a first bootie including a first integrated midsole portion, where the first bootie is configured to be inserted into the article of footwear and a second bootie including a second integrated midsole portion, where the second bootie is configured to be inserted into the article of footwear. The first integrated midsole portion is configured to provide targeted cushioning to a first portion of the article of footwear and the second integrated midsole is configured to provide targeted cushioning to a second portion of the article of footwear. The first portion is different than the second portion.

In another aspect, an interchangeable bootie system includes an article of footwear, a group of booties. Each bootie of the group of booties including an integrated midsole portion, where each of the booties is configured to be received in the article of footwear and where the integrated midsole portion of each bootie of the group of booties provides cushioning for a different region of a foot so that the booties may be interchanged with one another to accommodate different athletic activities.

In another aspect, a kit of parts includes an article of footwear, a first bootie, where the first bootie is configured to be inserted into the article of footwear, and a first midsole insert, where the first midsole insert is configured to be inserted into the first bootie. The first midsole insert is configured to provide targeted cushioning to a first portion of the article of footwear. The article of footwear is configured to be used with a second midsole insert, where the second midsole insert is configured to be inserted into the first bootie. The second midsole insert is configured to provide targeted cushioning to a second portion of the article of footwear, where the first portion is different than the second portion.

In another aspect, an interchangeable bootie and midsole insert system includes an article of footwear, a group of booties, and a group of insertable midsole portions. Each of the insertable midsole portions is configured to be received in each of the booties, where each of the booties is configured to be received in the article of footwear. Each insertable midsole portion of the group of insertable midsole portions provides targeted cushioning for a different region of a foot so that the insertable midsole portions may be interchanged with one another and the booties to accommodate different athletic activities.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
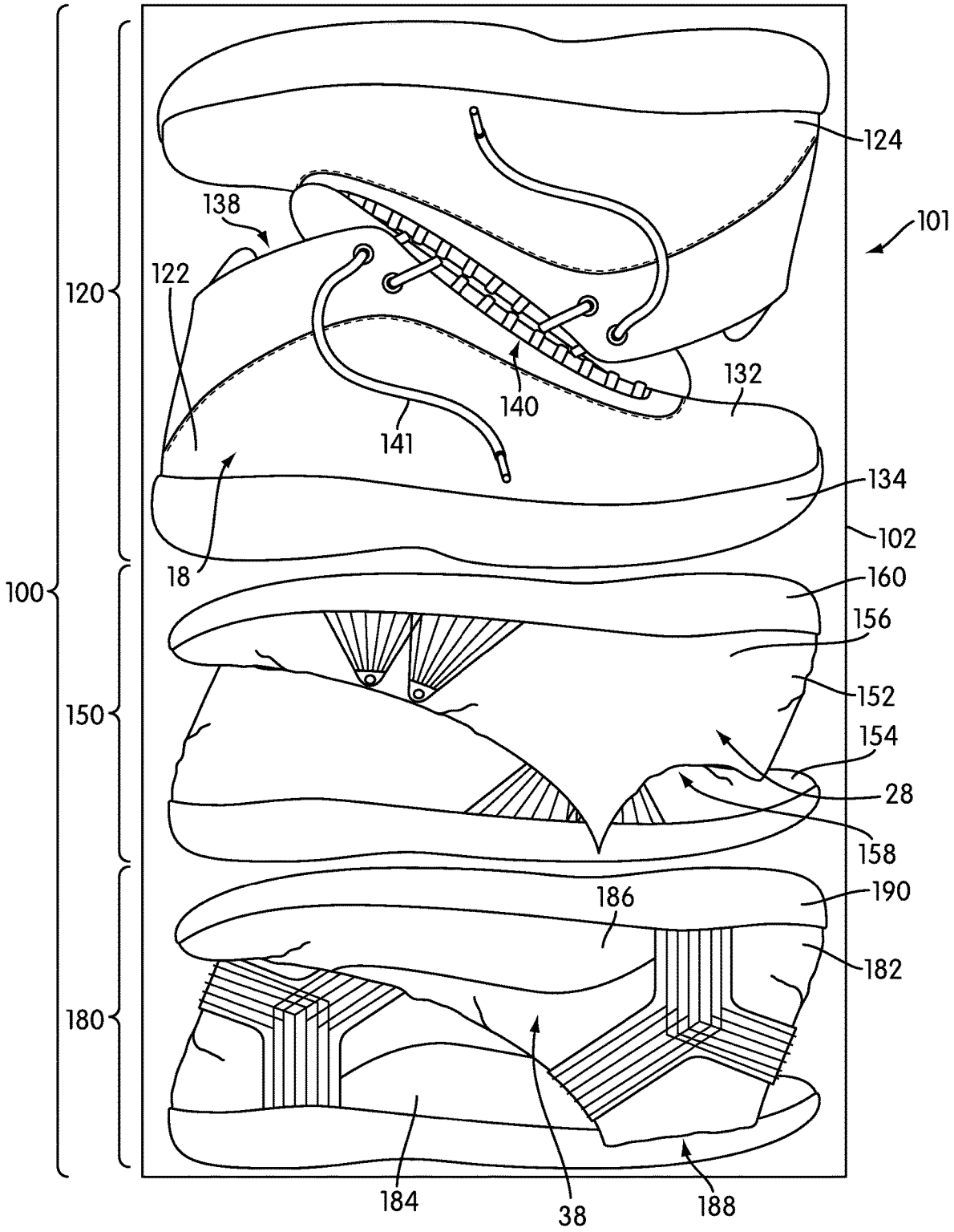
FIG. 1 is a top down view of an embodiment of a footwear kit including a container and an interchangeable bootie system.
Figure 2:
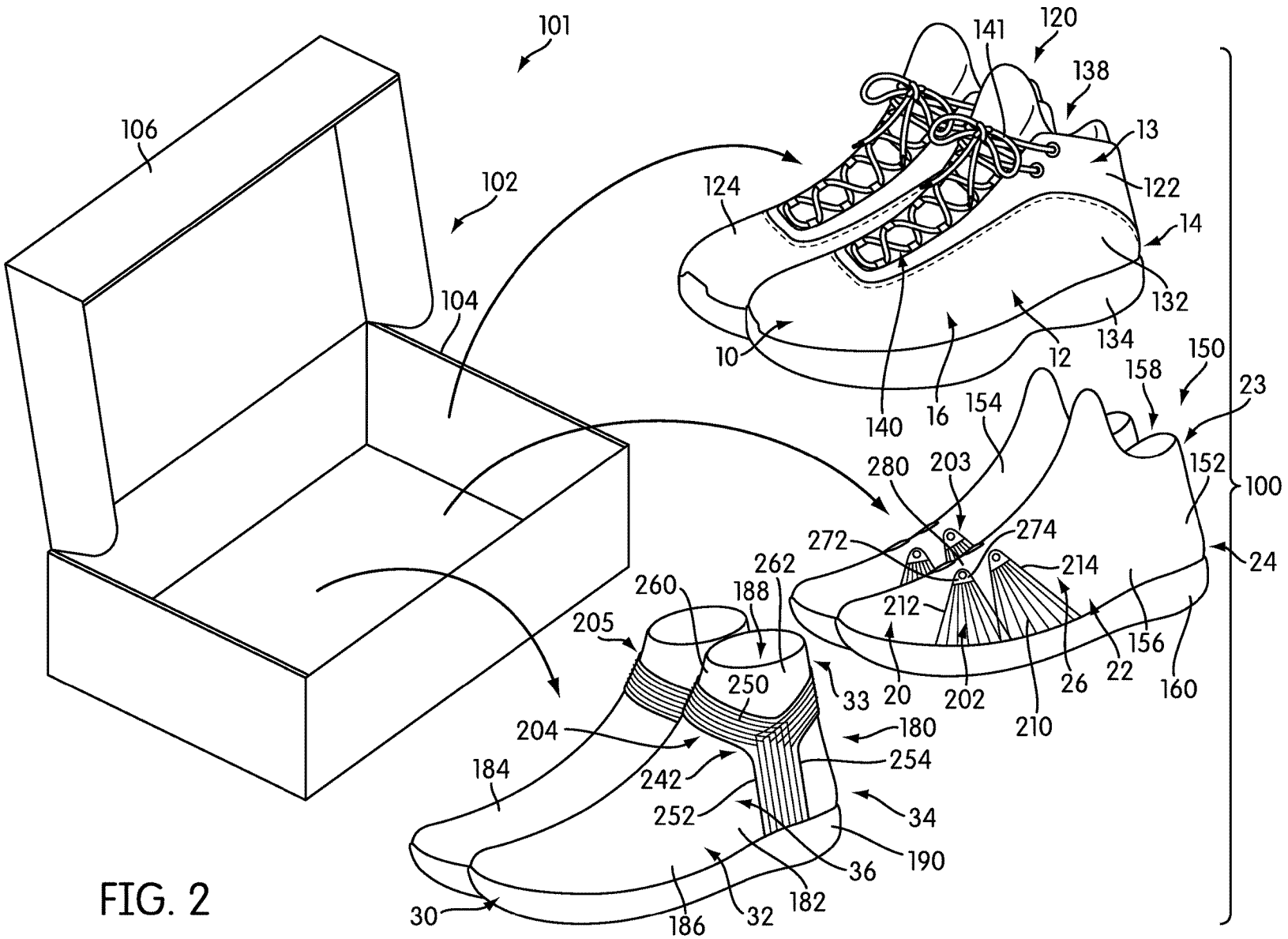
FIG. 2 is an isometric view of an embodiment of the kit shown in FIG. 1.

FIGS. 1 and 2 illustrate top down and isometric views, respectively, of kit of parts 101, or simply kit 101. In some cases, kit 101 may comprise one or more articles of footwear, accessories for these articles and/or a container for storing the articles. In other cases, kit 101 could include any other provisions not discussed below including, but not limited to: instructions, various kinds of media (such as CDs, DVDs, etc.), additional storage containers for storing articles and/or article accessories as well as any other provisions.

Kit 101 may be offered for sale at a retail location, such as a retail store, kiosk, factory outlet, manufacturing store and/or through an online vendor. In some cases, the various parts of kit 101 are sold together. In other cases, however, some parts of kit 101 may be sold separately. As an example, the current embodiment describes a kit of parts including a pair of footwear and two pairs of corresponding booties. In some cases, a retailer could sell a kit including the footwear and two pairs of booties and the retailer could also sell one or more pairs of booties separately from kit 101.

Kit 101 may include container 102. Container 102 can be any type of container configured to store at least one article of footwear. In some cases, container 102 may be a box. In an exemplary embodiment, container 102 may be a shoebox that is configured to store footwear. In particular, container 102 may have a generally rectangular shape and can include lower portion 104 and lid 106. In other embodiments, container 102 could be a bag, sack or other type of container. In still other embodiments, the various items in kit 101 may not be provided in a container.

In some embodiments, kit 101 includes pair of footwear 120 that includes first article of footwear 122 and second article of footwear 124. Generally, articles of footwear associated with kit 101 can be any type of footwear. For clarity, the following detailed description discusses articles of footwear in the form of sports shoes, but it should be noted that in other embodiments any other type of footwear could be used including, but not limited to: hiking boots, soccer shoes, football shoes, sneakers, rugby shoes, basketball shoes, baseball shoes as well as other kinds of shoes. Articles of footwear associated with kit 101 may also take the form of any non-athletic shoe, including, but not limited to, dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

First article of footwear 122 and second article of footwear 124 may be oriented for a left foot and a right foot, respectively. For purposes of clarity, the following detailed description discusses first article of footwear 122, but it will be understood that each of the features discussed for first article of footwear 122 could also apply to second article of footwear 124. Furthermore, first article of footwear 122 may also be referred to as article 122 throughout the remainder of this detailed description.

Article 122 can include upper 132. Generally, upper 132 may be any type of upper. In particular, upper 132 may have any design, shape, size and/or color. For example, in embodiments where article 122 is a basketball shoe, upper 132 could be a high top upper that is shaped to provide high support on an ankle. In embodiments where article 122 is a running shoe, upper 132 could be a low top upper. In the current embodiment, upper 132 may be a mid-top type upper that can be used in basketball shoes as well as other types of footwear.

Upper 132 can further include opening 138 that provides entry for a foot into an interior cavity of upper 132. In some cases, opening 138 may be disposed at the ankle region of upper 132. However, in other cases, opening 138 could be disposed in any other region of upper 132. Additionally, the size of opening 138 may be controlled using lacing system 140, which includes lace 141.

Article 122 can also include sole structure 134. In some embodiments, sole structure 134 may be configured to provide traction for article 122. In addition to providing traction, sole structure 134 may attenuate ground reaction forces when compressed between the foot and the ground during walking, running or other ambulatory activities. The configuration of sole structure 134 may vary significantly in different embodiments to include a variety of conventional or non-conventional structures. In some cases, the configuration of sole structure 134 can be configured according to one or more types of ground surfaces on which sole structure 134 may be used. Examples of ground surfaces include, but are not limited to: natural turf, synthetic turf, dirt, as well as other surfaces.

Sole structure 134 extends between the foot and the ground when article 122 is worn. In different embodiments, sole structure 134 may include different components. For example, sole structure 134 may include an outsole, a midsole, and/or an insole. In some cases, one or more of these components may be optional.

Kit 101 may further include first pair of booties 150 and second pair of booties 180. The term "bootie" as used throughout this detailed description and in the claims refers to any component that is generally configured to receive a foot. In some cases, booties could be configured for use with an article of footwear. A removable bootie, for example, could be inserted into an upper in order to receive the foot and provide an additional layer of cushioning, support, structure, protection as well as any other user needs. In some cases, booties can be provided with various structures such as tongues, fastening systems, cushioning and supporting systems.

First pair of booties 150 includes first bootie 152 and second bootie 154. For purposes of clarity, first bootie 152 is discussed in detail below, however, it will be understood that second bootie 154 may be configured with substantially similar provisions and in some cases could be substantially identical to first bootie 152.

First bootie 152 includes base layer 156 that has the approximate shape of a foot. In some cases, base layer 156 could be substantially flexible. In other cases, however, base layer 156 could be configured to be partially rigid. First bootie 152 may also include opening 158 for receiving a foot. In some embodiments, first bootie 152 can also include midsole portion 160. Midsole portion 160 may be more rigid than base layer 156 and can help to provide cushioning and shock absorption for the bottom of a foot. In some cases, midsole portion 160 can be used with booties that are inserted into articles without any other kind of midsole support. In other cases, midsole portion 160 can be used to reinforce midsole support already provided inside an article of footwear. In still other cases, midsole portion 160 could be optional and may not be included with some embodiments of a bootie.

Second pair of booties 180 includes first bootie 182 and second bootie 184. For purposes of clarity, first bootie 182 is discussed in detail below, however, it will be understood that second bootie 184 may be configured with substantially similar provisions and in some cases could be substantially identical to first bootie 182.

First bootie 182 includes base layer 186 that has the approximate shape of a foot. In some cases, base layer 186 could be substantially flexible. In other cases, however, base layer 186 could be configured to be partially rigid. First bootie 182 may also include opening 188 for receiving a foot. In some embodiments, first bootie 182 can also include midsole portion 190. Midsole portion 190 may be more rigid than base layer 186 and can help to provide cushioning and shock absorption for the bottom of a foot. In some cases, midsole portion 190 can be used with booties that are inserted into articles without any other kind of midsole support. In other cases, midsole portion 190 can be used to reinforce midsole support already provided inside an article of footwear. In still other cases, midsole portion 190 could be optional and may not be included with some embodiments of a bootie.

For consistency and convenience, directional adjectives are employed throughout this detailed description corresponding to the illustrated embodiments. These terms are used with various components including, but not limited to: an article of footwear, an upper, a sole structure and/or a bootie. The term "longitudinal" as used throughout this detailed description and in the claims refers to a direction extending a length or major axis of a component. In some cases, the longitudinal direction may extend from a forefoot portion to a heel portion of the component. Also, the term "lateral" as used throughout this detailed description and in the claims refers to a direction extending a width or minor axis of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article of footwear is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole structure and/or other components such as a bootie.

A component associated with an article of footwear and/or bootie may also be described by reference to various portions, such as a "forefoot portion", a "midfoot portion", a "heel portion" and an "ankle portion". The forefoot portion may be generally associated with the toes and joints connecting the metatarsals with the phalanges. The midfoot portion may be generally associated with the arch and/or middle of a foot. Likewise, the heel portion may be generally associated with the heel of a foot, including the calcaneus bone. The ankle portion may generally be associated with the ankle of a foot. In addition, an article of footwear and/or bootie can also be described by reference to a "lateral side" and a "medial side". The lateral side and medial side may be opposing sides of a component. Furthermore, both the lateral side and the medial side may extend through the forefoot portion, midfoot portion, ankle portion and heel portion.

For example, referring to FIG. 2, article 122 can include forefoot portion 10, midfoot portion 12, ankle portion 13 and heel portion 14. Article 122 can also include lateral side 16 and medial side 18 (see FIG. 1). In addition, referring to both FIGS. 2 and 3, first bootie 152 includes forefoot portion 20, midfoot portion 22, ankle portion 23 and heel portion 24, as well as lateral side 26 and medial side 28 (see FIG. 1). Likewise, first bootie 182 includes forefoot portion 30, midfoot portion 32, ankle portion 33 and heel portion 34 as well as lateral side 36 and medial side 38 (see FIG. 1).

It will be understood that the terms forefoot portion, midfoot portion, ankle portion and heel portion are only intended for purposes of description and are not intended to demarcate precise regions of an article, bootie or other footwear component. Likewise, the terms lateral side and medial side are intended to represent generally two sides of a component, rather than precisely demarcating the component into two halves.

As shown in FIGS. 1 and 2, pair of footwear 120, first pair of booties 150 and second pair of booties 180 may be collectively referred to as interchangeable bootie system 100. The term interchangeable bootie system as used throughout this detailed description and in the claims refers to any set of two or more removable booties that can be used with a single article of footwear. For example, in the current embodiment, first bootie 152 of first pair of booties 150 and first bootie 182 of second pair of booties 180 can be used in an interchangeable manner with first article of footwear 122. Likewise, second bootie 154 of first pair of booties 150 and second bootie 184 of second pair of booties 180 can be used in an interchangeable manner with second article of footwear 124. Although each pair of booties includes different provisions, as discussed in detail below, they are configured so that either first pair of booties 150 or second pair of booties 180 can be used with pair of footwear 120 according to the user's preference and/or needs.

In some embodiments, pair of footwear 120, first pair of booties 150 and second pair of booties 180 could be packaged together within container 102 as shown in FIG. 1. However, in other embodiments, other arrangements of footwear 120, booties 150 and booties 180 are possible. In some cases, for example, each pair of booties could be placed in an individual container, such as a cloth bag or plastic box that fits within container 102. In still other embodiments, footwear 120 may be packaged separately from booties 150 and booties 180, though these components may still be offered for sale together as interchangeable bootie system 100.

An interchangeable bootie system can include provisions that allow a user to modify the type of support provided by an article of footwear. For example, when participating in sports such as track or cross country running, a user may want increased support in the region of the forefoot. However, when participating in sports such as basketball, a user may want increased support in the region of the ankle to help reduce the likelihood of an ankle injury. In some embodiments, an interchangeable bootie system can provide customizable support through the use of different booties that provide targeted support to various regions of the foot.

Figure 3:
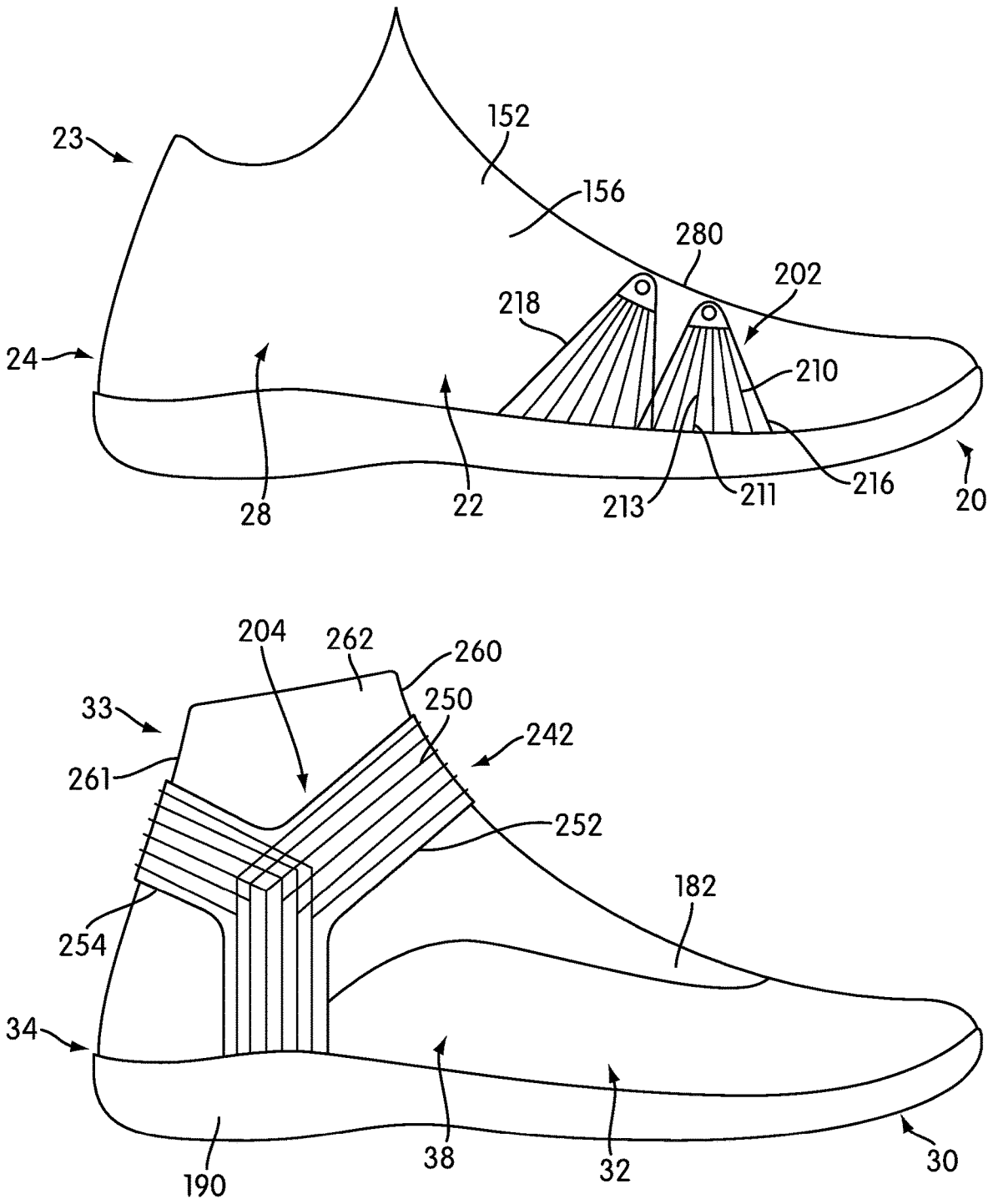
FIG. 3 is an isometric view of an embodiment of two booties for use with an article of footwear.

Referring to FIGS. 2 and 3, first pair of booties 150 and second pair of booties 180 may be configured to provide different types of support for a user when inserted into pair of footwear 120. In one embodiment, first pair of booties 150 comprise mid-top type booties that approximately correspond to the shapes of the uppers of pair of footwear 120. In contrast, second pair of booties 180 comprise high-top type booties. In particular, the ankle portions 33 of second pair of booties 180 are substantially higher than ankle portion 13 of pair of footwear 120, especially at the rearward end of ankle portion 13. This arrangement allows second pair of booties 180 to provide higher ankle support to the ankles when inserted into pair of footwear 120.

A bootie can be configured with one or more support systems that provide targeted support to a particular anatomical region of a foot. Each support system can be configured with one or more support structures. Examples of different support structures include, but are not limited to: threads, wires, straps, cords, tendons as well as any other structures that modify the physical properties of a bootie in order to provide enhanced strength and support.

In some embodiments, first bootie 152 includes first support system 202. First support system 202 comprises plurality of threads 210. More specifically, threads 210 are collected into various thread groups in order form structural elements for first bootie 152. The term "thread" as used throughout this detailed description and in the claims refers to any generally one-dimensional material. As utilized with respect to the present embodiments, the term "one-dimensional material" or variants thereof is intended to encompass generally elongate materials exhibiting a length that is substantially greater than a width and a thickness. Some possible materials that may be used as threads include, but are not limited to: wires, yarns, strings as well as any other generally one-dimensional materials.

In some cases, plurality of threads 210 may include first thread group 212, second thread group 214, third thread group 216 and fourth thread group 218. First thread group 212 includes threads extending from lateral side 26 of bootie 152 to top portion 280 of bootie 152. In some cases, the threads of first thread group 212 are bunched together at top portion 280 of bootie 152 and spread outwardly from each other towards lateral side 26.

First thread group 212 can include provisions for interacting with a lacing system. In one embodiment, the threads of first thread group 212 are attached together at end portions 272 and joined with lace receiving portion 274. Lace receiving portion 274 may be configured to receive a lace of an article of footwear. In other embodiments, first thread group 212 may not be attached to a lace receiving portion and may instead be fastened directly to top portion 280 of bootie 152.

Second thread group 214 may be configured in a similar manner, with threads joined together at top portion 280 and spreading radially outward towards lateral side 26. In some cases, third thread group 216 and fourth thread group 218 may be configured in a similar manner on medial side 28 of bootie 152.

In different embodiments, threads 210 may be disposed in various portions of bootie 152. In one embodiment, first thread group 212, second thread group 214, third thread group 216 and fourth thread group 218 are disposed on forefoot portion 20 of first bootie 152. Using this arrangement, first thread group 212, second thread group 214, third thread group 216 and fourth thread group 218 form structural elements that tend to resist stretching at forefoot portion 20 and reinforce bootie 152 against forces that are applied to forefoot portion 20. In other words, this configuration for first support system 202 helps to provide targeted structural support at forefoot portion 20, while allowing for increased stretching and flexibility at midfoot portion 22, ankle portion 23 and heel portion 24.

It will be understood that in some embodiments, a substantially similar support system 203 may be provided on second bootie 154 that includes a similar threaded configuration. In other cases, however, support system 203 could be substantially different than first support system 202.

In some embodiments, first bootie 182 of second pair of booties 180 includes second support system 242. Second support system 242 comprises plurality of threads 250. More specifically, threads 250 are collected into various thread groups in order form structural elements for first bootie 182. In some cases, plurality of threads 250 may include first thread group 252 and second thread group 254. First thread group 252 extends from midsole portion 190 at medial side 38 of heel portion 34 and upwardly into ankle portion 33 and around forward portion 260 of throat 262. First thread group 252 then extends back down to lateral side 36 of heel portion 34 in a similar manner. Second thread group 254 extends from midsole portion 190 at medial side 38 of heel portion 34 and upwardly into ankle portion 33 and around rearward portion 261 of throat 262. Second thread group 254 then extends back down to lateral side 36 of heel portion 34 in a similar manner.

In some cases, each thread of first thread group 252 and second thread group 254 may be spaced apart by a substantially constant amount. In other cases, however, the spacing between threads in first thread group 252 and/or second thread group 254 could vary.

Using this arrangement, first thread group 252 and second thread group 254 form structural elements that tend to resist stretching at ankle portion 33 and reinforce bootie 182 against forces that are applied to ankle portion 33. In other words, this configuration for second support system 204 helps to provide targeted structural support at ankle portion 33, while allowing for increased stretching and flexibility at forefoot portion 30 and midfoot portion 32.

It will be understood that in some embodiments, a substantially similar support system 205 may be provided on second bootie 184 that includes a similar threaded configuration. In other cases, however, support system 205 could be substantially different than second support system 204.

The current embodiment illustrates support systems for first bootie 152 and first bootie 182 that are approximately symmetric between the lateral and medial sides of each bootie. In other embodiments, a support system may not be symmetric in order to provide differential support along the medial and lateral sides of the foot. For example, in another embodiment, a support system could include a greater number of threads on a medial side of the bootie than on the lateral side of the bootie in order to provide greater support on the medial side.

Articles with threads configured to provide structural support have been previously disclosed in U.S. Patent Application Publication No. 2007/0271822, to Meschter, the entirety of which is hereby incorporated by reference. In addition, U.S. Patent Application Publication No. 2007/0271823, also to Meschter, is hereby incorporated by reference. These two references will be referred to as the Meschter cases throughout the remainder of this detailed description.

The process of applying threads to a base layer can be achieved using any method known in the art. In particular, the order of application of different threads from various thread groups can vary from one embodiment to another. Examples of a process for applying threads to an upper for an article of footwear are discussed in the Meschter cases.

The following method illustrates principles of attaching threads to a base layer using first bootie 152, however it will be understood that similar principles could be used for attaching threads to any other booties. Referring to FIG. 3, in some cases, the end portions 211 of each of threads 210 can be secured to base layer 156 using a lock stitch. In addition, intermediate portions 213 of each of threads 210 may be attached to base layer 156 using a connecting layer that bonds, secures, or otherwise joins portions of threads 210 to base layer 156. In other embodiments, however, threads 210 could be embedded in base layer 156, especially in embodiments where base layer 156 comprises a polymer layer.

In different embodiments, the materials utilized in constructing various components and structures may vary. For example, a base layer for a bootie could be constructed of any kind of material, including but not limited to various kinds of textiles. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven fabric. The textiles may incorporate fibers that are arranged to impart one-directional stretch or multi-directional stretch, and the textiles may include coatings that form a breathable and water-resistant barrier, for example. Examples of textile materials that could be used include, but are not limited to: animal textiles, such as wools and silks, plant textiles, such as cotton, flax, and lyocell, synthetic textiles such as polyester, aramid, acrylic, nylon, spandex, olefin fiber, ingeo, lurex and carbon fibers. In other embodiments, materials used for making the base layer of a bootie could include non-woven fabrics, polymer layers, natural leathers, synthetic leathers as well as any other materials. In some cases, polymer sheets could be used that may be extruded, rolled, or otherwise formed from a polymer material to exhibit a generally flat aspect. Bootie materials may also encompass laminated or otherwise layered materials that include two or more layers of textiles, polymer sheets, or combinations of textiles and polymer sheets.

Figure 4:
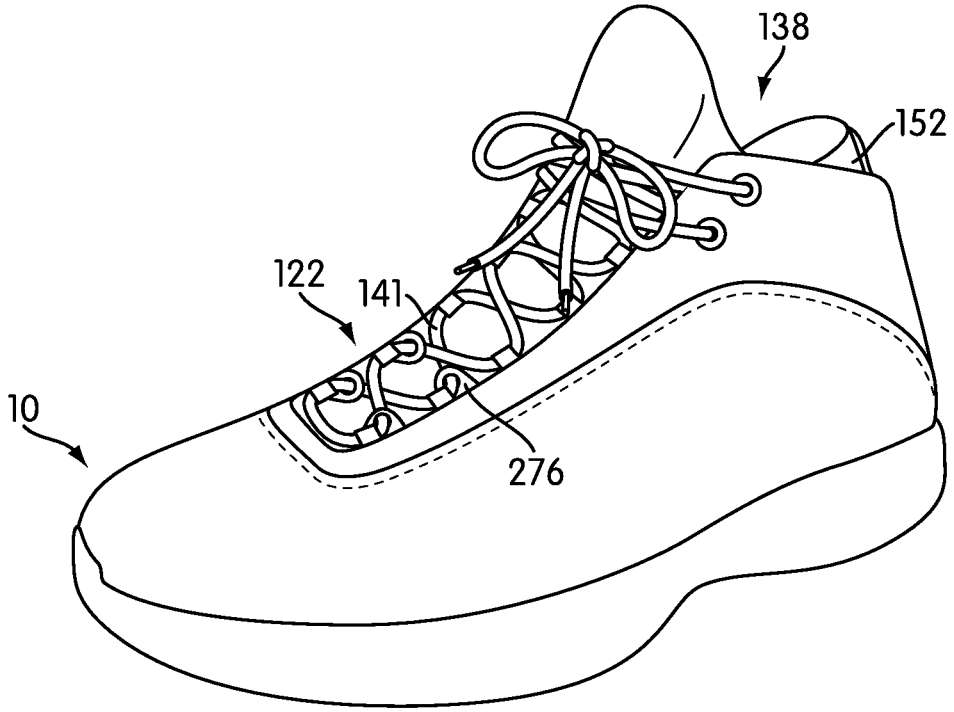
FIG. 4 is an isometric view of an embodiment of a bootie with forefoot support inserted into an article of footwear.
Figure 5:
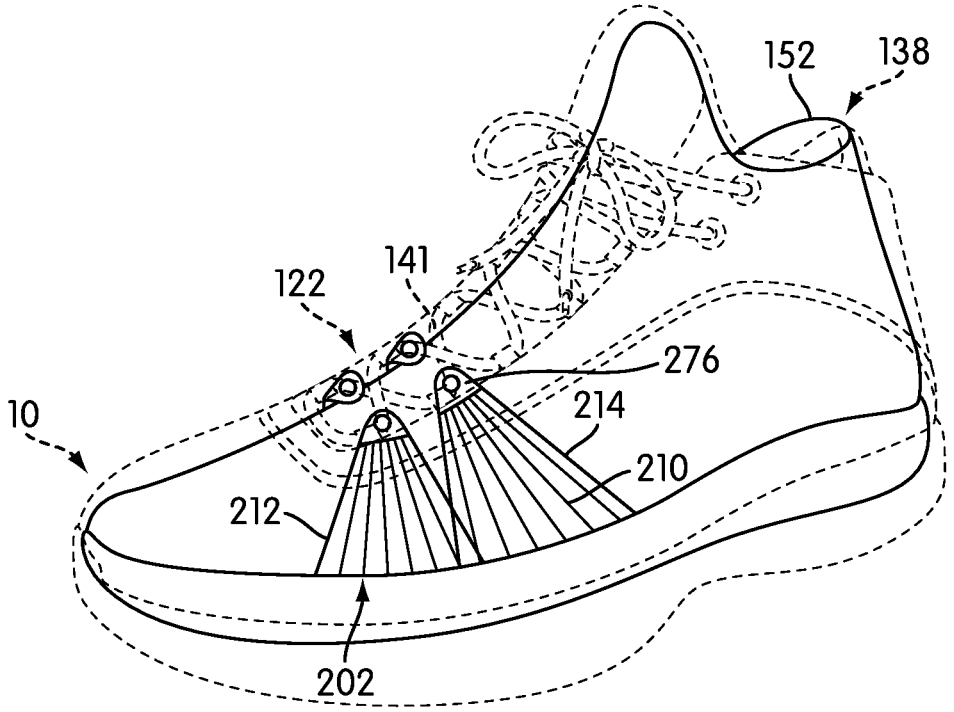
FIG. 5 is an isometric view of an embodiment of a bootie with forefoot support inserted into an article of footwear, where the article is shown in phantom.

FIGS. 4 and 5 illustrate isometric views of an embodiment of bootie 152 assembled with article 122. For purposes of illustration, article 122 is shown in phantom in FIG. 5. Referring to FIGS. 4 and 5, bootie 152 may be inserted through opening 138. In some cases, bootie 152 may be secured inside article 122 using some kind of fastening means including, but not limited to: hook and loop fasteners, snaps, zippers, straps and or any other kinds of fasteners. In some cases, lace 141 of article 122 may be inserted through lace receiving portions 276 of first thread group 212, second thread group 214 as well as third thread group 216 and fourth thread group 218 (not shown). This arrangement can help to secure bootie 152 and also provides tension in threads 210 as lace 141 is tightened.

With bootie 152 inserted into article 122, first support system 202 is configured to provide targeted support to forefoot portion 10 of article 122. In particular, threads 210 of first support system 202 help to resist stretching and reinforce forefoot portion 10. A user may choose this type of targeted forefoot support for activities such as sprinting, track, cross country running, soccer as well as other types of athletic activities that require enhanced forefoot support.

Figure 6:
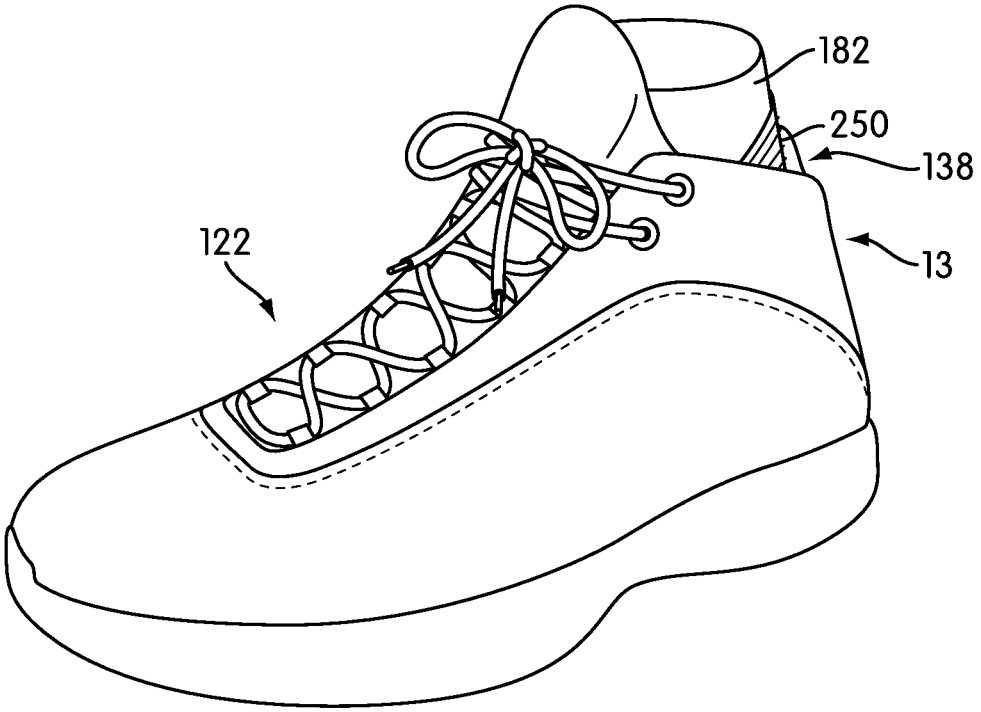
FIG. 6 is an isometric view of an embodiment of a bootie with ankle support inserted into an article of footwear.
Figure 7:
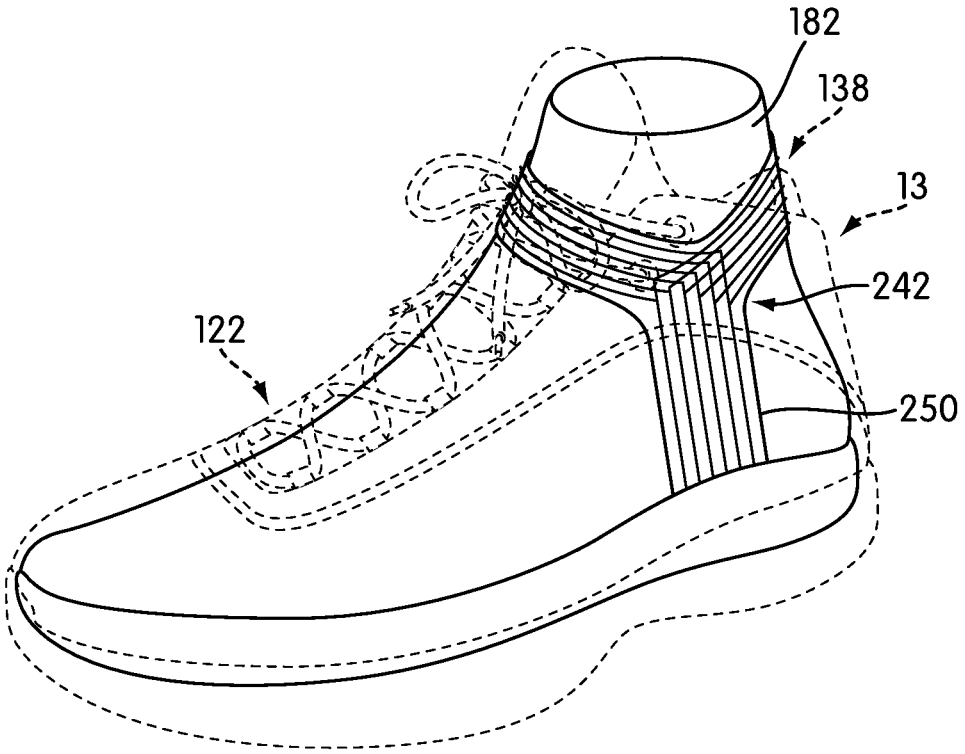
FIG. 7 is an isometric view of an embodiment of a bootie with ankle support inserted into an article of footwear, where the article is shown in phantom.

FIGS. 6 and 7 illustrate isometric views of an embodiment of bootie 182 assembled with article 122. For purposes of illustration, article 122 is shown in phantom in FIG. 7. Referring to FIGS. 6 and 7, bootie 182 may be inserted through opening 138. In some cases, bootie 182 may be secured inside article 122 using some kind of fastening means including, but not limited to: hook and loop fasteners, snaps, zippers, straps and or any other kinds of fasteners.

With bootie 182 inserted into article 122, second support system 242 is configured to provide targeted support to ankle portion 13 of article 122. In particular, threads 250 of second support system 242 help to resist stretching and reinforce ankle portion 13. A user may choose this type of targeted forefoot support for activities such as basketball, skateboarding as well as other types of athletic activities that require enhanced ankle support.

As illustrated in FIGS. 4 through 7, interchangeable bootie system 100 (see FIG. 1) allows a user to customize the type of support provided by an article of footwear. For example, a user may select first bootie 152 for use with article 122 in order to provide targeted forefoot support. Likewise, when targeted ankle support is desired, a user may select first bootie 182 for use with article 122. This arrangement reduces the need for a user to purchase different pairs of footwear for different support needs. Instead, the user can simply interchange one bootie having one type of support system with another bootie having a different kind of support system.

Figure 8:
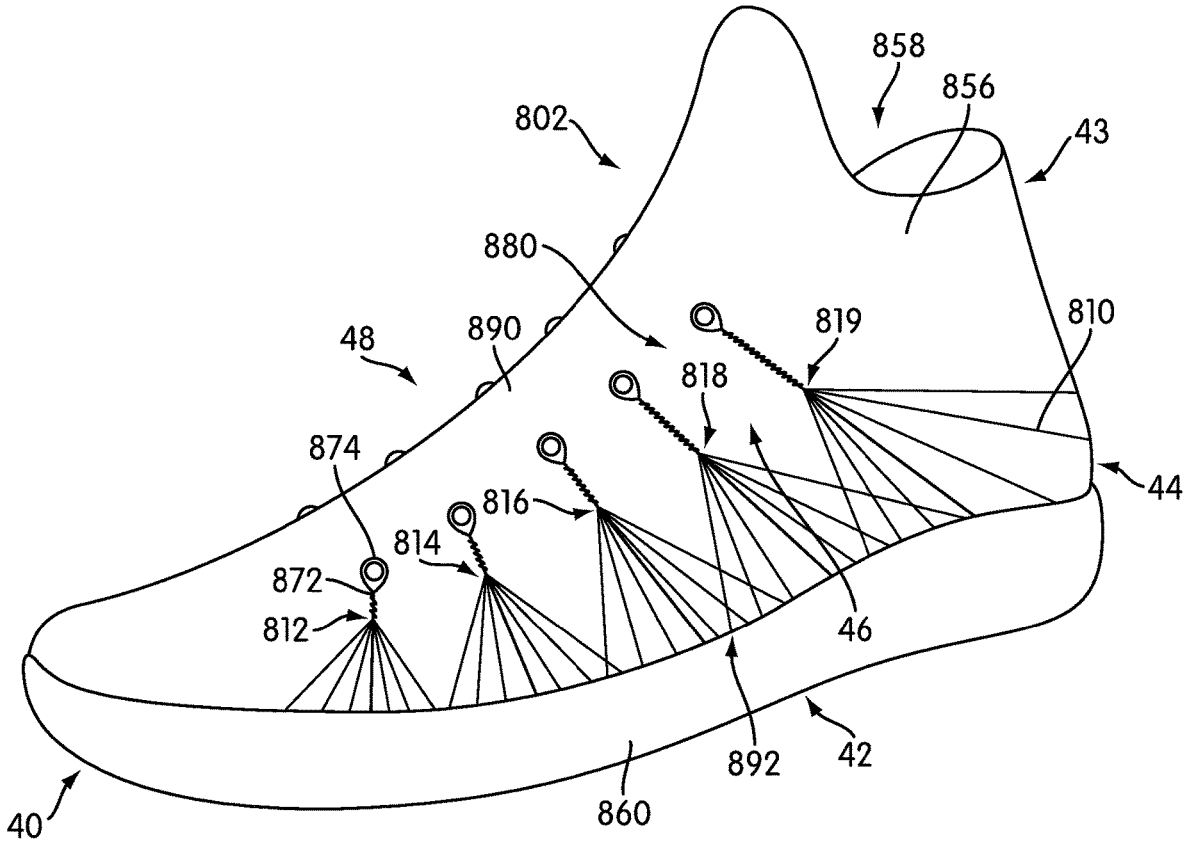
FIG. 8 is an isometric view of an embodiment of a bootie with midfoot support.

FIG. 8 illustrates another embodiment of a bootie configured to provide targeted support. Referring to FIG. 8, bootie 802 includes forefoot portion 40, midfoot portion 42, ankle portion 43 and heel portion 44 as well as lateral side 46 and medial side 48. Bootie 802 includes base layer 856 that has the approximate shape of a foot. In some cases, base layer 856 could be substantially flexible. In other cases, however, base layer 856 could be configured to be partially rigid. Bootie 802 may also include opening 858 for receiving a foot.

In some embodiments, bootie 802 can also include midsole portion 860. Midsole portion 860 may be more rigid than base layer 856 and can help to provide cushioning and shock absorption for the bottom of a foot. In some cases, midsole portion 860 can be used with booties that are inserted into articles without any other kind of midsole support. In other cases, midsole portion 860 can be used to reinforce additional midsole support inside an article of footwear. In still other cases, midsole portion 860 could be optional and may not be included with some embodiments of a bootie.

In some embodiments, bootie 802 includes third support system 880. Third support system 880 comprises plurality of threads 810. More specifically, threads 810 are collected into various thread groups in order form structural elements for bootie 802. In some cases, plurality of threads 810 may include first thread group 812, second thread group 814, third thread group 816, fourth thread group 818 and fifth thread group 819 on lateral side 46. In some cases, similar thread groups may be disposed in an approximately symmetric manner on medial side 48.

First thread group 812 includes threads extending from lateral side 46 of bootie 802 to top portion 890 of bootie 802. In some cases, the threads of first thread group 812 are bunched together at top portion 890 of bootie 802. The threads of first thread group 812 may be twisted together for some length and then spread outwardly from each other towards lateral side 46. In one embodiment, the threads of first thread group 812 are attached together at end portions 872 and joined with lace receiving portion 874. Lace receiving portion 874 may be configured to receive a lace of an article of footwear.

In some cases, second thread group 814, third thread group 816, fourth thread group 818 and fifth thread group 819 may be configured in a similar manner to first thread group 812. In other cases, however, each thread group could be configured in a different manner.

Third support system 880 is intended to provide midfoot support for an article of footwear. In some cases, third support system 880 may be disposed on midfoot portion 42 of bootie 802. In particular, third support system 880 includes threads that extend from the bottom arch portion 892 of bootie 802 towards top portion 890 in order to help provide targeted support and reinforce the arch and midfoot of an article of footwear. Additionally, in some cases, third support system 880 may also include threads that extend into heel portion 44 in order to provide targeted heel support. However, in other embodiments, heel support could be optional. This type of bootie may be selected by a user for use with an article when playing sports such as football, running, or other types of activities that require enhanced midfoot and/or arch support.

In some cases, bootie 802 could be incorporated as a third type of support bootie into interchangeable bootie system 100. For example, in some cases, an interchangeable bootie system could include three different types of booties that provide three different kinds of targeted support. In other cases, however, bootie 802 could be combined with either first bootie 152 or first bootie 182 to provide a user with two different support types. Thus, a retailer could provide a user with a kit including two or three different types of booties, where each type of bootie is configured to provide a different kind of targeted support for specific regions of a foot.

Figure 9:
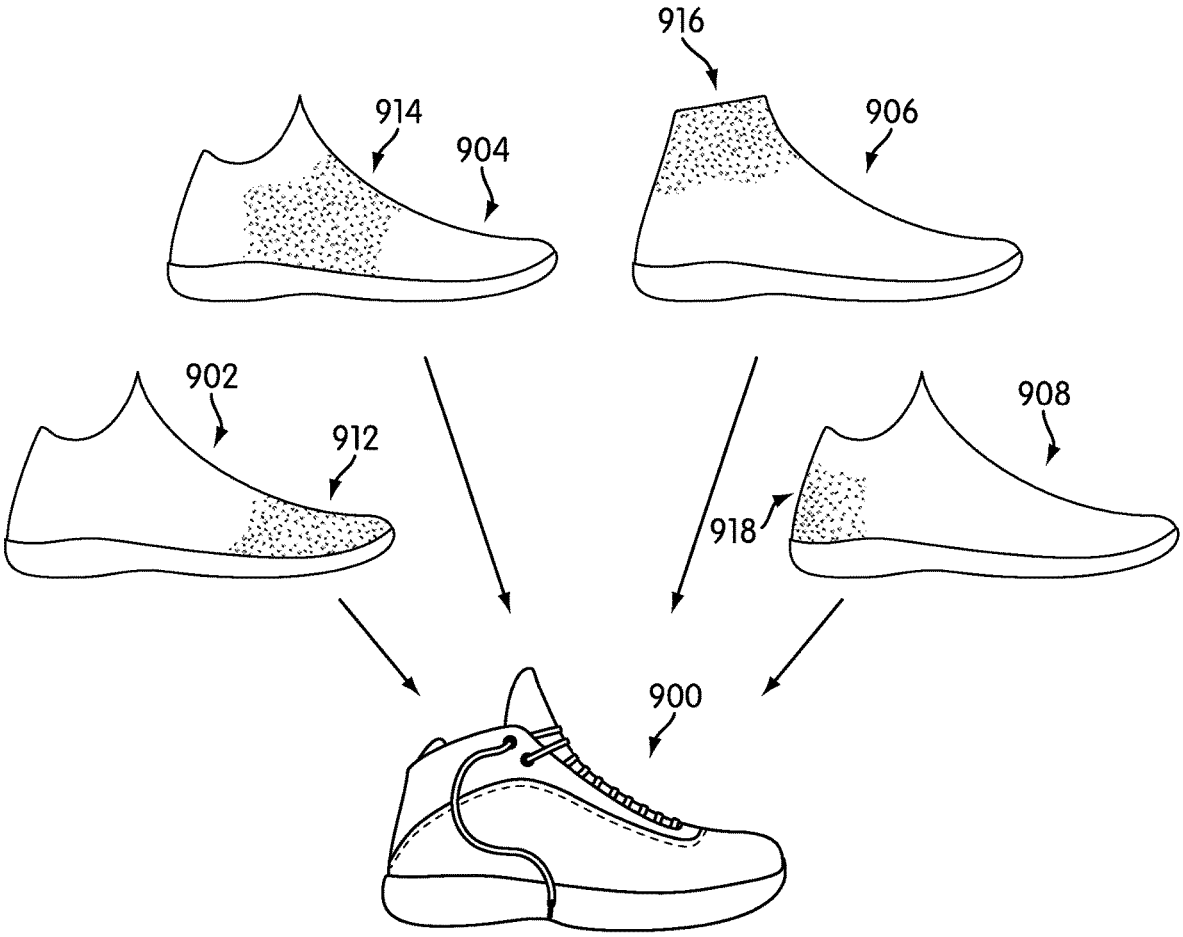
FIG. 9 is a schematic view of an embodiment of an interchangeable bootie system including four booties with differing types of support.

FIG. 9 illustrates a schematic view of various types of booties that can be used with an interchangeable bootie system for an article of footwear. Referring to FIG. 9, first bootie 902, second bootie 904, third bootie 906 and fourth bootie 908 may be configured for use with article 900. Each bootie includes a shaded region indicating the type of targeted support that may be used with that particular bootie. For example, first bootie 902 may include targeted support in forefoot portion 912. Second bootie 904 may include targeted support in midfoot portion 914. Third bootie 906 may include targeted support in ankle portion 916. Also, fourth bootie 908 may include targeted support in heel portion 918.

In some embodiments, two or more types of targeted support may be included in a single bootie. For example, in an exemplary embodiment, first bootie 902 with targeted support in forefoot portion 912 may be combined with additional support in any one or more of midfoot portion 914, ankle portion 916, and heel portion 918. Similarly, second bootie 904 with targeted support in midfoot portion 914 may be combined with additional support in any one or more of forefoot portion 912, ankle portion 916, and heel portion 918. Similar combinations of multiple types of targeted support may be included in third bootie 906 and/or fourth bootie 908. With this arrangement, a single bootie may be configured to include targeted support to multiple regions of a foot.

Booties with support systems providing targeted support to different portions of a foot may be combined in any manner to provide various kinds of interchangeable bootie systems. For example, in one embodiment, first bootie 902 and second bootie 904 could be packaged with an article of footwear to provide an interchangeable bootie system where a user may select between targeted forefoot support and targeted midfoot support. Likewise, in another embodiment, third bootie 906 and fourth bootie 908 could be packaged with an article of footwear to provide an interchangeable bootie system where a user may select between targeted ankle support and targeted heel support. Of course, it may be that some interchangeable bootie systems include three, four or more types of booties from which a user can select. In addition, in some embodiments, interchangeable bootie systems may include booties that provide targeted support to multiple regions of a foot. For example, in one embodiment, a bootie that provides targeted forefoot support and targeted midfoot support could be packaged with a bootie that provides targeted heel support and targeted ankle support. In other embodiments, different combinations of booties including multiple types of targeted support may be packaged together in accordance with the principles described herein.

It will be understood that the structures used for making a support system can vary in different embodiments. For example, a support system could comprise threads, wires, straps, cords, tendons, cushions as well as any other structures that provide support, strength as well as any other desired characteristics.

Figure 10:
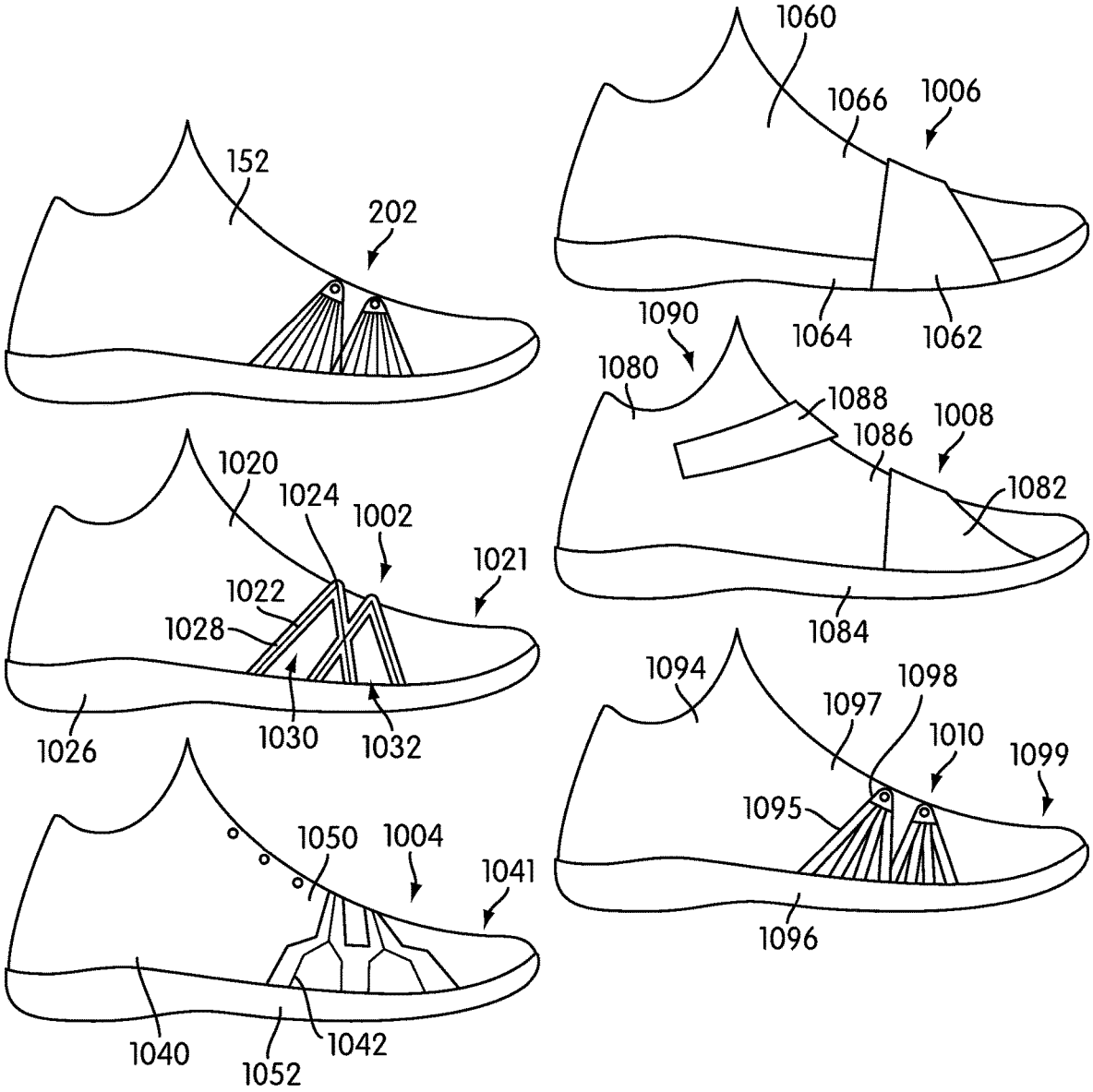
FIG. 10 is a schematic view of an embodiment of different types of bootie configurations providing forefoot support.
Figure 11:
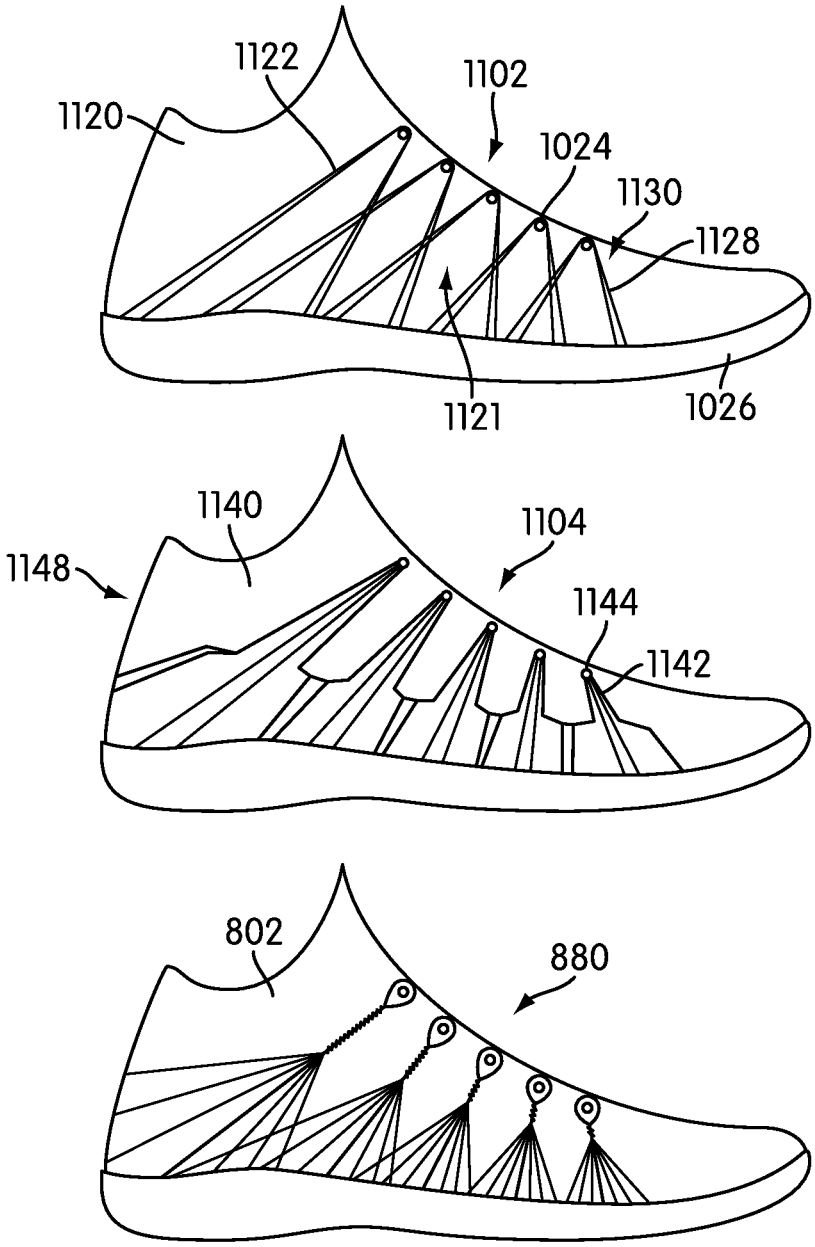
FIG. 11 is a schematic view of an embodiment of different types of bootie configurations providing midfoot support.
Figure 12:
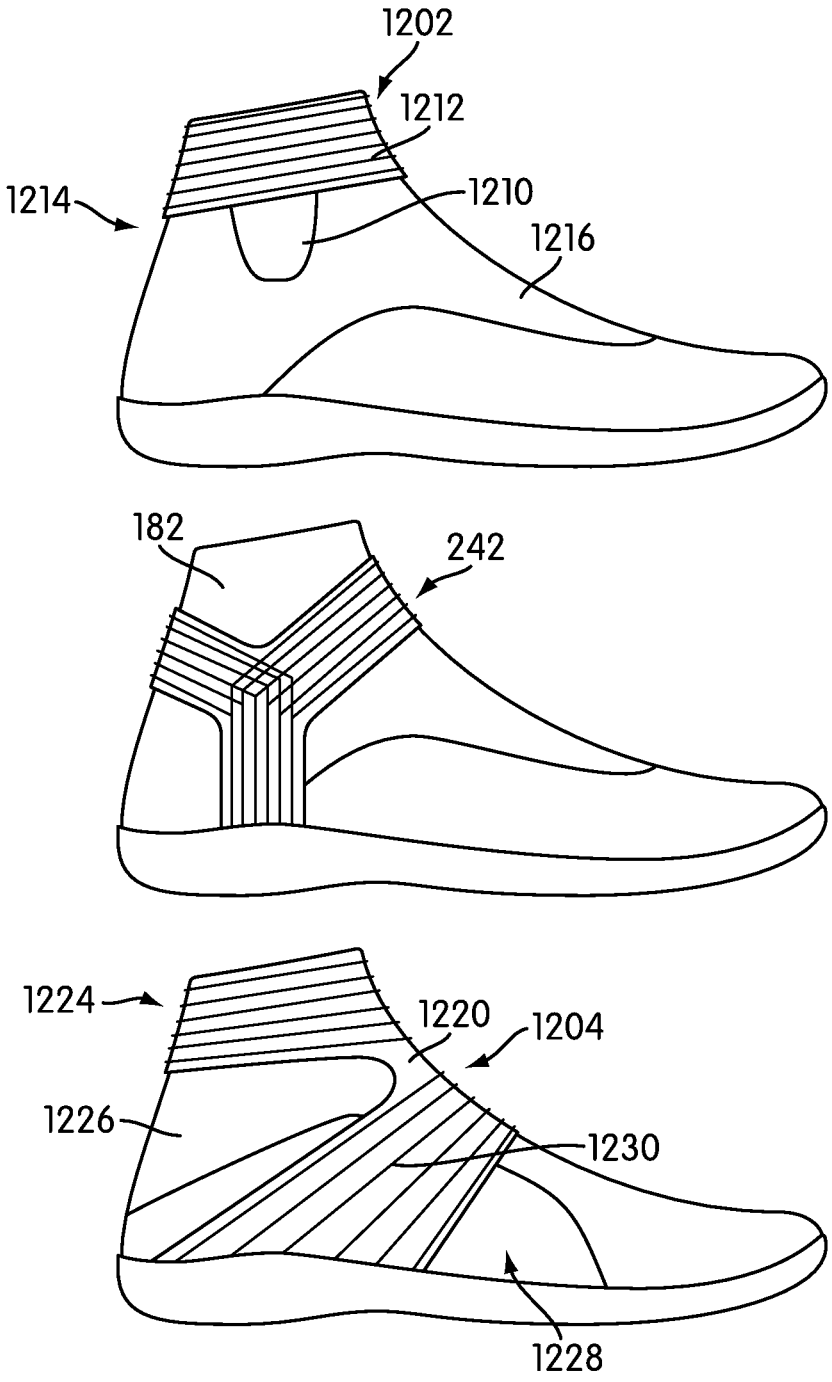
FIG. 12 is a schematic view of an embodiment of different types of bootie configurations providing ankle support.

FIGS. 10 through 12 illustrate schematic views of various kinds of support systems for booties configured to provide targeted support. It will be understood that the specific types of support systems illustrated in FIGS. 10 through 12 are only intended to be exemplary and in other embodiments other types of support systems could be used.

FIG. 10 illustrates schematic views of various kinds of support systems for booties configured to provide targeted forefoot support when used with an article of footwear. One example of such a support system, first support system 202, has already been described in detail in the previous embodiments. However, other configurations for support systems providing targeted forefoot support are also possible. The current embodiment illustrates five other possible support systems including support system 1002, support system 1004, support system 1006, support system 1008 and support system 1010.

Support system 1002 utilizes threads 1022 that extend along lateral and medial sides of forefoot portion 1021 of bootie 1020. Threads 1022 may be joined at end portions 1024 and may extend towards midsole portion 1026. In contrast to support system 202 of a previous embodiment, however, threads 1022 are arranged in bands 1028 that form the outer edges of two triangular regions 1030 and 1032. Thus, support system 1002 provides an alternative threaded configuration for helping resist stretching and to reinforce forefoot portion 1021. Similarly, support system 1004 utilizes still another alternative threaded configuration. In particular, threads 1042 extend along lateral and medial sides of forefoot portion 1041 of bootie 1040. Threads 1042 may be bunched together towards top portion 1050 of bootie 1040, but may fan out towards midsole portion 1052 of bootie 1040.

Support system 202, support system 1002 and support system 1004 all provide various threaded support systems in which threads are arranged in different configurations or patterns. By varying the configuration of the threads, the physical properties of the forefoot portion of a bootie can be varied. In particular, modifying the density, direction and spacing between threads helps to provide varying kinds of support.

Support system 1006 and support system 1008 utilize straps to provide targeted support. For example, support system 1006 includes strap 1062 that extends from below midsole portion 1064 to top portion 1066 of bootie 1060. In some cases, strap 1062 could be an adjustable strap. In other cases, strap 1062 may not be adjustable. Support system 1008 includes strap 1082 that extends along bootie 1080 from a location adjacent to midsole portion 1084 to top portion 1086. In some cases, support system 1008 can also include strap 1088 that extends along top portion 1086 of bootie 1080 adjacent to opening 1090. In some cases, strap 1082 and/or strap 1088 may be adjustable straps. In other cases, however, strap 1082 and/or strap 1088 may be fixed in place. The straps used in support system 1006 and support system 1008 may provide increased tension around the forefoot of a user's foot in order to improve stability.

Support system 1010 may comprise a plurality of tensioning strips 1095 that extend from midsole portion 1096 to top portion 1097 of bootie 1094. In some cases, tensioning strips 1095 can be joined at lace receiving portions 1098 and may spread outwardly towards the lateral and medial sides of bootie 1094. This may provide structural support to forefoot portion 1099 by reducing the tendency of forefoot portion 1099 to stretch.

FIG. 11 illustrates schematic views of various kinds of support systems for booties configured to provide targeted midfoot support when used with an article of footwear. One example of such a support system, third support system 880, has already been described in detail in the previous embodiments. However, other configurations for support systems providing targeted midfoot and arch support are also possible. The current embodiment illustrates two other possible types of support systems providing targeted midfoot support including support system 1102 and support system 1104.

Support system 1102 utilizes threads 1122 that extend along lateral and medial sides of midfoot portion 1121 of bootie 1120. Threads 1122 may be joined at lace receiving portions 1124 and may extend towards midsole portion 1126. In contrast to support system 880 of a previous embodiment, however, threads 1122 are arranged in narrow bands 1128 that form the outer edges of triangular regions 1130. Thus, support system 1102 provides an alternative threaded configuration for helping resist stretching and reinforcing midfoot portion 1121. Support system 1104 utilizes an alternative threaded configuration for bootie 1140 in which threads 1142 initially extend radially outward from lace receiving portions 1144. However, threads 1142 are arranged to form a wider threaded pattern without any overlapping threads.

In some cases, support systems that are configured to provide midfoot and arch support for the foot may also provide some support for the heel. For example, support system 1104 includes some threads 1142 that extend to heel portion 1148 in order to help reduce the tendency of bootie 1140 to stretch at the heel. This placement of threads 1142 may also help provide structural support to the heel.

FIG. 12 illustrates schematic views of various kinds of support systems for booties configured to provide targeted ankle support when used with an article of footwear. One example of such a support system, second support system 242, has already been described in detail in the previous embodiments. However, other configurations for support systems providing targeted ankle support are also possible. The current embodiment illustrates two other possible types of support systems providing targeted ankle support including support system 1202 and support system 1204.

Support system 1202 includes ankle strap 1210 disposed on ankle portion 1214 of bootie 1216. Support system 1202 also includes threads 1212 that are generally wrapped in a circular manner around ankle strap 1210. In some cases, strap 1210 could be an adjustable strap. In other cases, strap 1210 may not be adjustable. Support system 1204 includes strap 1220 that wraps around ankle portion 1224 and midfoot portion 1228 of bootie 1226. In some cases, support system 1204 can also include threads 1230 that act to reinforce strap 1220 and help resist stretching at ankle portion 1224 as well as midfoot portion 1228.

An interchangeable bootie system can include provisions that allow a user to modify the type of cushioning and/or shock absorption provided by an article of footwear. For example, when participating in sports such as track or cross country running, a user may want increased cushioning and/or shock absorption in the region of the forefoot. However, when participating in sports such as basketball, a user may want increased cushioning and/or shock absorption in the region of the midfoot and/or heel. In some embodiments, an interchangeable bootie system can provide customizable cushioning and/or shock absorption through the use of different booties having integrated midsole portions that provide targeted cushioning and/or shock absorption to various regions of the foot.

Figure 13:
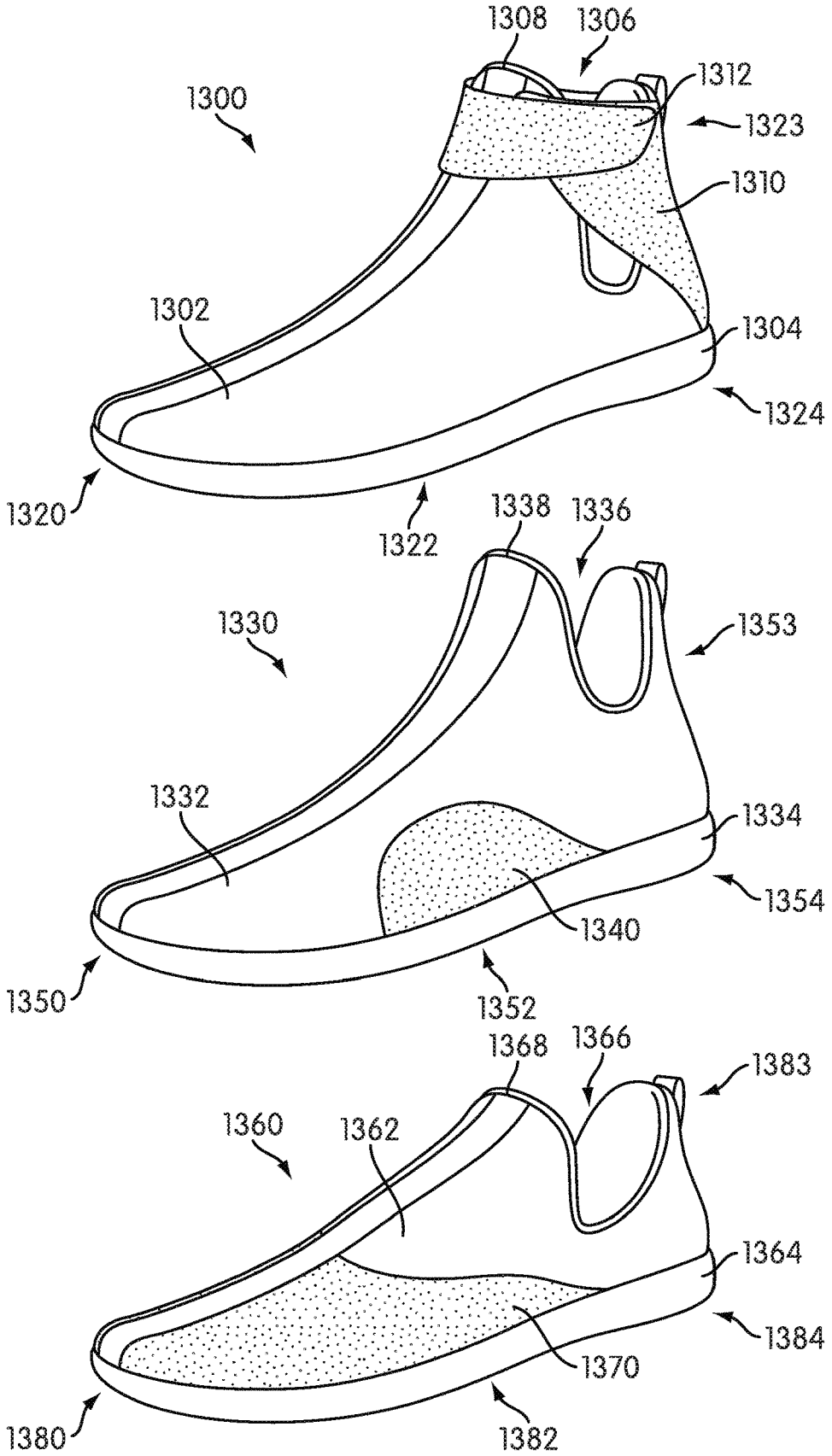
FIG. 13 is an isometric view of an embodiment of three booties including integrated midsole portions with cushioning systems for use with an article of footwear.
Figure 14:
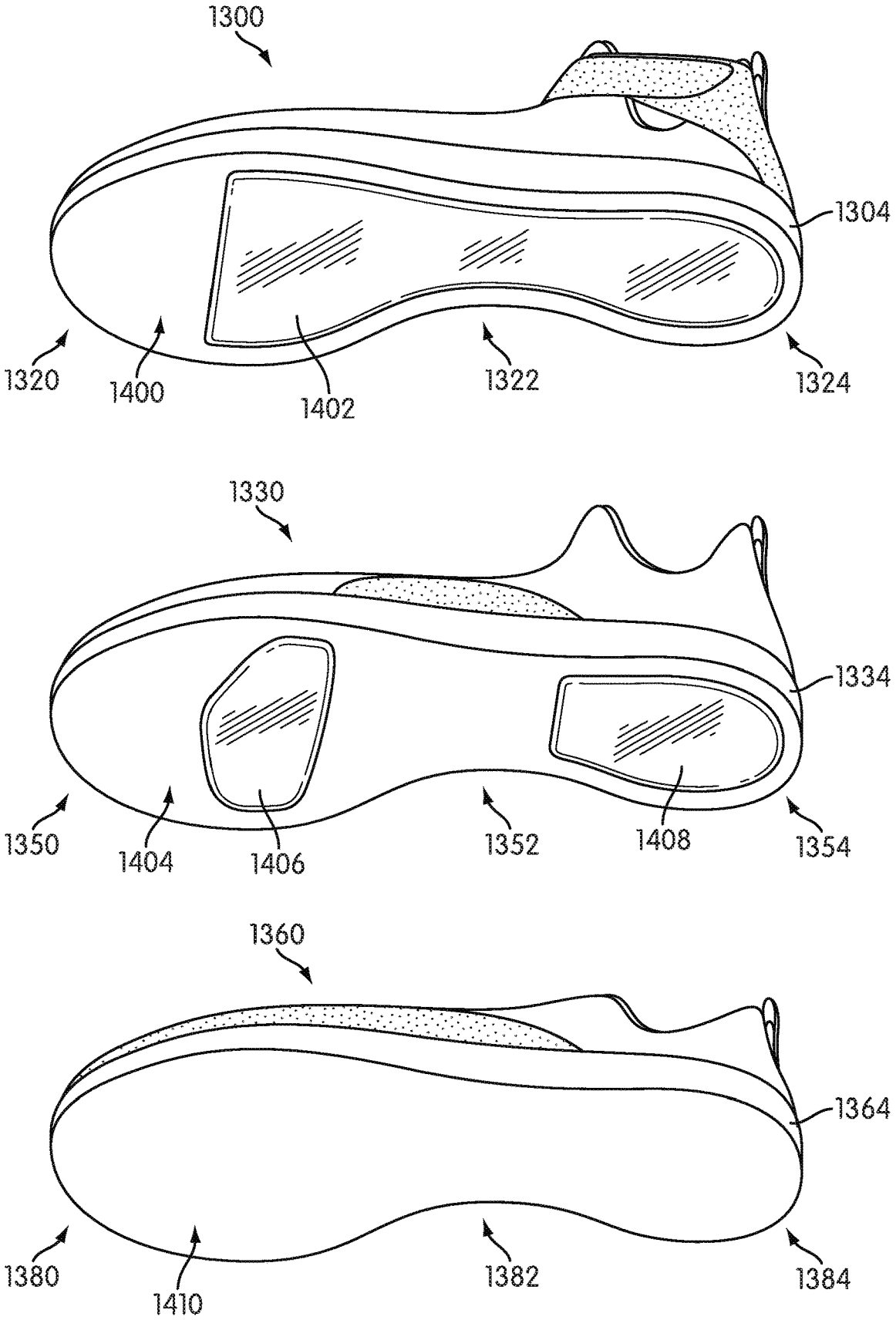
FIG. 14 is an isometric view of the underside of embodiments of integrated midsole portions with cushioning systems of three booties for use with an article of footwear.

Referring to FIGS. 13 and 14, a bootie can be configured with one or more support systems that provide targeted support to a particular anatomical region of a foot, as described above. In an exemplary embodiment, each bootie can further be configured with integrated midsole portions including a cushioning system that provides targeted cushioning and/or shock absorption to a particular anatomical region of a foot. Referring now to FIG. 13, in this embodiment, three exemplary embodiments of booties having different support systems and integrated midsole portions with different cushioning systems are illustrated. It should be understood that each of the booties illustrated in FIG. 13 may be one of a pair of booties configured to be used with a pair of footwear in a kit of parts together as part of interchangeable bootie system 100, described above.

In one embodiment, a first bootie 1300 may be provided as a high-top bootie. In this embodiment, an ankle portion 1323 of first bootie 1300 is configured to sit high on an ankle of a foot of a user. In some embodiments, first bootie 1300 may include one or more similar components as previous embodiments of a bootie, described above. In this embodiment, first bootie 1300 includes base layer 1302 that has the approximate shape of a foot. In some cases, base layer 1302 could be substantially flexible. In other cases, however, base layer 1302 could be configured to be partially rigid. First bootie 1300 may also include opening 1306 for receiving a foot. In some embodiments, first bootie 1300 may also include a tongue 1308. In some cases, tongue 1308 may be used to provide additional cushioning to a top of a foot a user when first bootie 1300 is inserted within an article including a tongue. In other cases, tongue 1308 may used to replace a tongue associated with an article of footwear.

In some embodiments, first bootie 1300 can be provided with a first support system 1310. In this embodiment, first support system 1310 is disposed on a heel portion 1324 and an ankle portion 1323 of first bootie 1300. First support system 1310 may include any type of support system described herein. In an exemplary embodiment, first support system 1310 can be provided with a wrap portion 1312 that wraps around and encircles an ankle of a user when a foot is inserted within first bootie 1300. With this arrangement, first support system 1310 on first bootie 1300 may be configured to provide support to a heel portion and an ankle portion of an article of footwear when first bootie 1300 is inserted within.

In some embodiments, first bootie 1300 can also include a first integrated midsole portion 1304. In this embodiment, first integrated midsole portion 1304 extends from forefoot portion 1320 of first bootie 1300 through a midfoot portion 1322 to heel portion 1324. In other embodiments, however, first integrated midsole portion 1304 may extend through one or more portions of forefoot portion 1320, midfoot portion 1322, and/or heel portion 1324. In some embodiments, first integrated midsole portion 1304 may be provided with a cushioning system to help to provide cushioning and shock absorption for the bottom of a foot. In some cases, first integrated midsole portion 1304 can be used with booties that are inserted into articles without any other kind of midsole support. In other cases, first integrated midsole portion 1304 can be used to reinforce midsole support already provided inside an article of footwear.

In one embodiment, a second bootie 1330 may be provided as a high-top bootie. In this embodiment, an ankle portion 1353 of second bootie 1330 is configured to sit hit on an ankle of a foot of a user. In some embodiments, second bootie 1330 may include one or more similar components as previous embodiments of a bootie, described above. In this embodiment, second bootie 1330 includes base layer 1332 that has the approximate shape of a foot. In some cases, base layer 1332 could be substantially flexible. In other cases, however, base layer 1332 could be configured to be partially rigid. Second bootie 1330 may also include opening 1336 for receiving a foot. In some embodiments, second bootie 1330 may also include a tongue 1338. In some cases, tongue 1338 may be used to provide additional cushioning to a top of a foot a user when second bootie 1330 is inserted within an article including a tongue. In other cases, tongue 1338 may used to replace a tongue associated with an article of footwear.

In some embodiments, second bootie 1330 can be provided with a second support system 1340. In this embodiment, second support system 1340 is disposed on a midfoot portion 1352 of second bootie 1330. Second support system 1340 may include any type of support system described herein. In addition, it should be understood that second bootie 1330 may include a similar support system as second support system 1340 disposed on an opposite side of second bootie 1330. In an exemplary embodiment, second support system 1340 can be provided to support an arch of a foot of a user when the foot is inserted within second bootie 1330. With this arrangement, second support system 1340 on second bootie 1330 may be configured to provide support to a midfoot portion of an article of footwear when second bootie 1330 is inserted within.

In some embodiments, second bootie 1330 can also include a second integrated midsole portion 1334. In this embodiment, second integrated midsole portion 1334 extends from a forefoot portion 1350 of second bootie 1330 through midfoot portion 1352 to a heel portion 1354. In other embodiments, however, second integrated midsole portion 1334 may extend through one or more portions of forefoot portion 1350, midfoot portion 1352, and/or heel portion 1354. In some embodiments, second integrated midsole portion 1334 may be provided with a cushioning system to help to provide cushioning and shock absorption for the bottom of a foot. In some cases, second integrated midsole portion 1334 can be used with booties that are inserted into articles without any other kind of midsole support. In other cases, second integrated midsole portion 1334 can be used to reinforce midsole support already provided inside an article of footwear.

In one embodiment, a third bootie 1360 may be provided as a low-top bootie. In this embodiment, an ankle portion 1383 of third bootie 1360 is configured to sit low on an ankle of a foot of a user. In some embodiments, third bootie 1360 may include one or more similar components as previous embodiments of a bootie, described above. In this embodiment, third bootie 1360 includes base layer 1362 that has the approximate shape of a foot. In some cases, base layer 1362 could be substantially flexible. In other cases, however, base layer 1362 could be configured to be partially rigid. Third bootie 1360 may also include opening 1366 for receiving a foot. In some embodiments, third bootie 1360 may also include a tongue 1368. In some cases, tongue 1368 may be used to provide additional cushioning to a top of a foot a user when third bootie 1360 is inserted within an article including a tongue. In other cases, tongue 1368 may used to replace a tongue associated with an article of footwear.

In some embodiments, third bootie 1360 can be provided with a third support system 1370. In this embodiment, third support system 1370 is disposed on a forefoot portion 1380 and a midfoot portion 1382 of third bootie 1360. Third support system 1370 may include any type of support system described herein. In addition, it should be understood that third bootie 1360 may include a similar support system as third support system 1370 disposed on an opposite side of third bootie 1360. In an exemplary embodiment, third support system 1370 can be provided to support a forefoot of a foot of a user when the foot is inserted within third bootie 1360. With this arrangement, third support system 1370 on third bootie 1360 may be configured to provide support to a forefoot portion and/or midfoot portion of an article of footwear when third bootie 1360 is inserted within.

In some embodiments, third bootie 1360 can also include a third integrated midsole portion 1364. In this embodiment, third integrated midsole portion 1364 extends from forefoot portion 1380 of third bootie 1360 through midfoot portion 1382 to a heel portion 1384. In other embodiments, however, third integrated midsole portion 1364 may extend through one or more portions of forefoot portion 1380, midfoot portion 1382, and/or heel portion 1384. In some embodiments, third integrated midsole portion 1364 may be provided with a cushioning system to help to provide cushioning and shock absorption for the bottom of a foot. In some cases, third integrated midsole portion 1364 can be used with booties that are inserted into articles without any other kind of midsole support. In other cases, third integrated midsole portion 1364 can be used to reinforce midsole support already provided inside an article of footwear.

Referring now to FIG. 14, the undersides of embodiments of integrated midsole portions with cushioning systems of three booties for use with an article of footwear are illustrated. In some embodiments, a cushioning system may include one or more cushioning elements that may be associated with one or more portions of an integrated midsole portion of a bootie.

In some embodiments, cushioning elements may be provided as inserts that incorporate various kinds of bladders and/or fluid chambers. Generally, any kind of fluid bladder and/or fluid chamber known in the art could be used. Examples of fluid bladders that may be used in embodiments that include bladder and/or fluid chamber footwear components are disclosed in the following patents and patent applications: Swigart (U.S. Pat. No. 9,161,592), now U.S. patent application Ser. No. 12/938,175, filed Nov. 2, 2010; Chao et al. (U.S. Pat. No. 8,869,430), now U.S. patent application Ser. No. 13/049,278, filed Mar. 16, 2011; Dojan et al. (U.S. Pat. No. 8,789,294), now U.S. patent application Ser. No. 13/049,268, filed Mar. 16, 2011; Hazenberg et al. (U.S. Pat. No. 9,021,720), now U.S. patent application Ser. No. 13/049,256, filed Mar. 16, 2011; Beye et al. (U.S. Pat. No. 8,470,113), now U.S. patent application Ser. No. 12/778,921, filed May 12, 2010; Monfils et al. (U.S. Pat. No. 8,464,439), now U.S. patent application Ser. No. 12/778,909, filed May 12, 2010; Passke, et al. (U.S. Pat. No. 7,210,249); Dojan, et al. (U.S. Pat. No. 7,409,779); Peyton (U.S. Pat. No. 8,479,412), now U.S. patent application Ser. No. 12/630,642; Peyton (U.S. Pat. No. 8,381,418), now U.S. patent application Ser. No. 12/777,167; Schindler (U.S. Pat. No. 7,131,218); Schindler et al. (U.S. Pat. No. 7,588,654); Schindler et al. (U.S. Pat. No. 7,591,919); Mitchell et al. (U.S. Pat. No. 5,713,141); Mitchell et al. (U.S. Pat. No. 5,952,065); Bonk et al. (U.S. Pat. No. 6,082,025); Bonk et al. (U.S. Pat. No. 6,127,026); Bonk et al. (U.S. Pat. No. 6,013,340); Bonk et al. (U.S. Pat. No. 6,203,868); Bonk et al. (U.S. Pat. No. 6,321,465); Rudy (U.S. Pat. No. 4,183,156); Rudy (U.S. Pat. No. 4,219,945); Dua et al. (U.S. Pat. No. 8,151,486), now U.S. patent application Ser. No. 12/123,612; and Rapaport, et al. (U.S. Pat. No. 8,241,451), now U.S. patent application Ser. No. 12/123,646. The entirety of all of the above patents or patent applications are hereby incorporated by reference. Furthermore, the number, geometry and locations of one or more bladders could be varied from one embodiment to another.

Referring again to FIG. 14, in this embodiment, first integrated midsole portion 1304 associated with first bootie 1300 includes a first cushioning system 1400. In an exemplary embodiment, first cushioning system 1400 may include a first cushioning element 1402. In this embodiment, first cushioning element 1402 extends from heel portion 1324 of first integrated midsole portion 1304 through midfoot portion 1322 and partially into forefoot portion 1320. With this arrangement, first cushioning system 1400 including first cushioning element 1402 can be configured to provide cushioning and/or shock absorption to a majority of a foot of a user when first bootie 1300 is disposed within an article of footwear.

In some embodiments, a cushioning system may include one or more cushioning elements that are disposed on one or more discrete portions of an integrated midsole portion. In an exemplary embodiment, second integrated midsole portion 1334 associated with second bootie 1330 includes a second cushioning system 1404. In this embodiment, second cushioning system 1404 includes a second cushioning element 1406 and a third cushioning element 1408. In this embodiment, second cushioning element 1406 is disposed in forefoot portion 1350 of second integrated midsole portion 1334 and third cushioning element 1408 is disposed in heel portion 1354 of second integrated midsole portion 1334. With this arrangement, second cushioning element 1406 can be configured to provide cushioning and/or shock absorption to a ball of a foot of a user and third cushioning element 1408 can be configured to provide cushioning and/or shock absorption to a heel of a foot of a user when second bootie 1330 with second cushioning system 1402 is disposed within an article of footwear. While in this embodiment midfoot portion 1352 of second integrated midsole portion 1334 is not provided with a cushioning element, in other embodiments, additional cushioning elements may be provided. In addition, in some embodiments, a cushioning element may be disposed only on a single portion of an integrated midsole portion.

In some embodiments, an integrated midsole portion may be provided with a cushioning system that does not include any separate cushioning elements. In an exemplary embodiment, third integrated midsole portion 1364 associated with third bootie 1360 is associated with a third cushioning system 1410. In this embodiment, third cushioning system 1410 includes only third integrated midsole portion, without any separate cushioning elements disposed therein. In this embodiment, cushioning and/or shock absorption for third cushioning system 1410 may be provided by third integrated midsole portion 1364. With this arrangement, third integrated midsole portion 1364 can be configured to provide cushioning and/or shock absorption to a foot of a user when third bootie 1360 is disposed within an article of footwear. In an exemplary embodiment, third integrated midsole portion 1364 may be lighter than a similar integrated midsole portion that includes one or more cushioning elements.

In FIG. 14, different embodiments of cushioning systems for use in the integrated midsole portions of various booties to provide cushioning and/or shock absorption to different portions of a foot are illustrated. In other embodiments, however, one or more cushioning systems associated with the integrated midsole portions may be arranged to provide different levels of cushioning and/or shock absorption to a bootie or to different portions of a bootie. With this arrangement, integrated midsole portions of a bootie may provide more or less cushioning and/or shock absorption to one or more portions of an article of footwear.

For example, in the previous embodiments, each cushioning system associated with its respective integrated midsole portion may provide a different level of cushioning to the bootie. In an exemplary embodiment, first integrated midsole portion 1304 associated with first bootie 1300 may include first cushioning system 1400 having first cushioning element 1402 that is associated with a first level of cushioning and/or shock absorption. Similarly, second integrated midsole portion 1334 associated with second bootie 1330 may include second cushioning system 1404 having second cushioning element 1406 associated with a second level of cushioning and/or shock absorption and/or third cushioning element 1408 associated with a third level of cushioning and/or shock absorption. In one embodiment, second level and third level of cushioning and/or shock absorption may be less than first level. In some cases, second level of cushioning and/or shock absorption may be less than third level. In other cases, second level of cushioning and/or shock absorption may be substantially similar to third level. In addition, third integrated midsole portion 1364 associated with third bootie 1360 may include third cushioning system 1410 that may be associated with a fourth level of cushioning and/or shock absorption. In an exemplary embodiment, fourth level of cushioning and/or shock absorption may be less than one or more of first level, second level, and third level. In other embodiments, however, third integrated midsole portion 1364 may be made of a harder or stiffer material so as to provide third cushioning system 1410 with a level of cushioning and/or shock absorption that is substantially similar to any of first level, second level, and third level.

Figure 15:
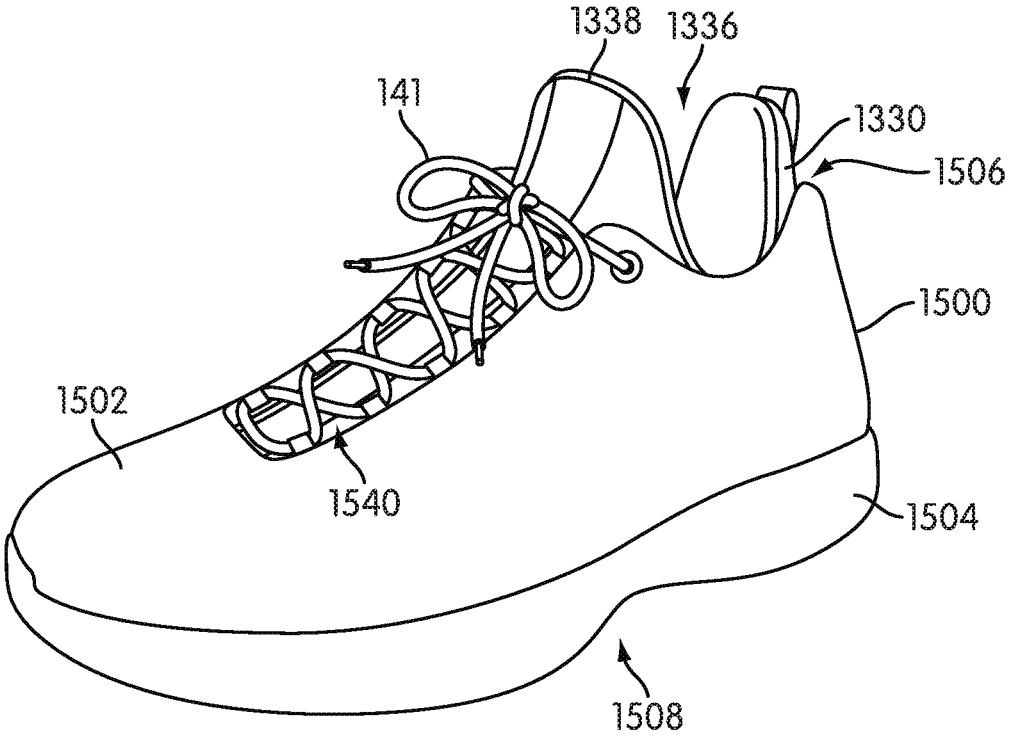
FIG. 15 is an isometric view of an embodiment of a bootie including an integrated midsole portion with a cushioning system inserted into an article of footwear.
Figure 16:
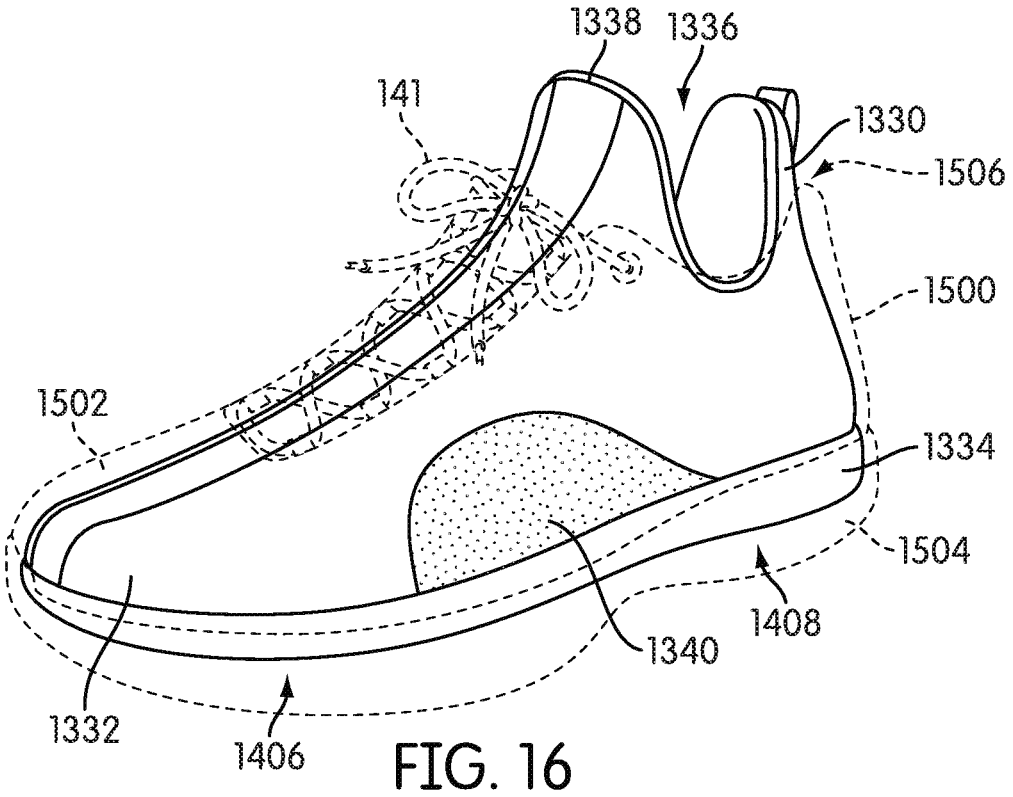
FIG. 16 is an isometric view of an embodiment of a bootie including an integrated midsole portion with a cushioning system inserted into an article of footwear, where the article is shown in phantom.

FIGS. 15 and 16 illustrate isometric views of an embodiment of second bootie 1330 including second integrated midsole portion 1334 with second cushioning system 1404 assembled with an article of footwear 1500. In this embodiment, article of footwear 1500 is a low-top article that is configured with a lacing system 1540 that includes lace 141. In addition, article 1500 may include one or more components of an article that are substantially similar to the components associated with article 122, such as an upper 1502 and a sole structure 1504. For purposes of illustration, article 1500 is shown in phantom in FIG. 16. Referring to FIGS. 15 and 16, second bootie 1330 may be inserted through an opening 1506. In some cases, second bootie 1330 may be secured inside article 1500 using some kind of fastening means including, but not limited to: hook and loop fasteners, snaps, zippers, straps and or any other kinds of fasteners. In other cases, second integrated midsole portion 1334 and second bootie 1330 may not be secured within article 1500 other than by lace 141 and fastening system 1540. With this arrangement, second bootie 1330 may be permitted to move slightly within the interior of article 1500.

With second bootie 1330 inserted into article 1500, second support system 1340 is configured to provide targeted support to midfoot portion 1508 of article 1500. In particular, second support system 1340 helps provide support to an arch and/or midfoot of a foot of a user. A user may choose this type of targeted arch support for activities such as basketball, baseball, running, track, cross country running, soccer as well as other types of athletic activities that require enhanced arch support.

In this embodiment, second bootie 1330 is illustrated with low-top article 1500. In an exemplary embodiment, article 1500 may be included in kit of parts 101 in place of article 122. It should be understood, however, that any of the booties described herein may be used with any article of footwear, including a high-top or mid-top article, including article 122, described above. In addition, in this embodiment, article 1500 does not include a separate tongue disposed on article 1500. Instead, tongue 1338 associated with second bootie 1330 may be configured to provide cushioning to a top of a foot of a user.

As illustrated in FIGS. 13 through 16, an interchangeable bootie system with booties having integrated midsole portions with different cushioning systems allows a user to customize the type of support and the type of cushioning and/or shock absorption provided by an article of footwear. For example, a user may select first bootie 1300 for use with article 1500 or article 122 in order to provide targeted ankle and/or heel support with first support system 1310 and to provide targeted cushioning and/or shock absorption to a majority of a foot with first integrated midsole portion 1304 including first cushioning system 1400. Likewise, when targeted arch and/or midfoot support and forefoot and heel cushioning is desired, a user may select second bootie 1330 with second support system 1340 and second integrated midsole portion 1334 including second cushioning system 1404 for use with article 1500 or article 122. This arrangement reduces the need for a user to purchase different pairs of footwear for different support and cushioning needs. Instead, the user can simply interchange one bootie having one type of support system and cushioning system with another bootie having a different kind of support system and cushioning system.

FIGS. 17 through 26 illustrate an exemplary embodiment of an interchangeable bootie and midsole insert system 1700. An interchangeable bootie and midsole insert system can include provisions that allow a user to separately modify the type of support and the type of cushioning and/or shock absorption provided by an article of footwear. In some embodiments, an interchangeable bootie and midsole insert system can provide customizable cushioning and/or shock absorption through the use of a midsole insert system that includes insertable midsole portions that provide targeted cushioning and/or shock absorption to various regions of the foot. In an exemplary embodiment, a midsole insert system may configured to be used with one or more embodiments of a bootie having different support systems, as described above as part of interchangeable bootie system 100.

With this arrangement, interchangeable bootie and midsole insert system 1700 can provide customizable support through the use of different booties that provide targeted support to various regions of the foot and also provide customizable cushioning and/or shock absorption through the use of different insertable midsole portions having cushioning systems that provide targeted cushioning and/or shock absorption to various regions of the foot.

Figure 17:
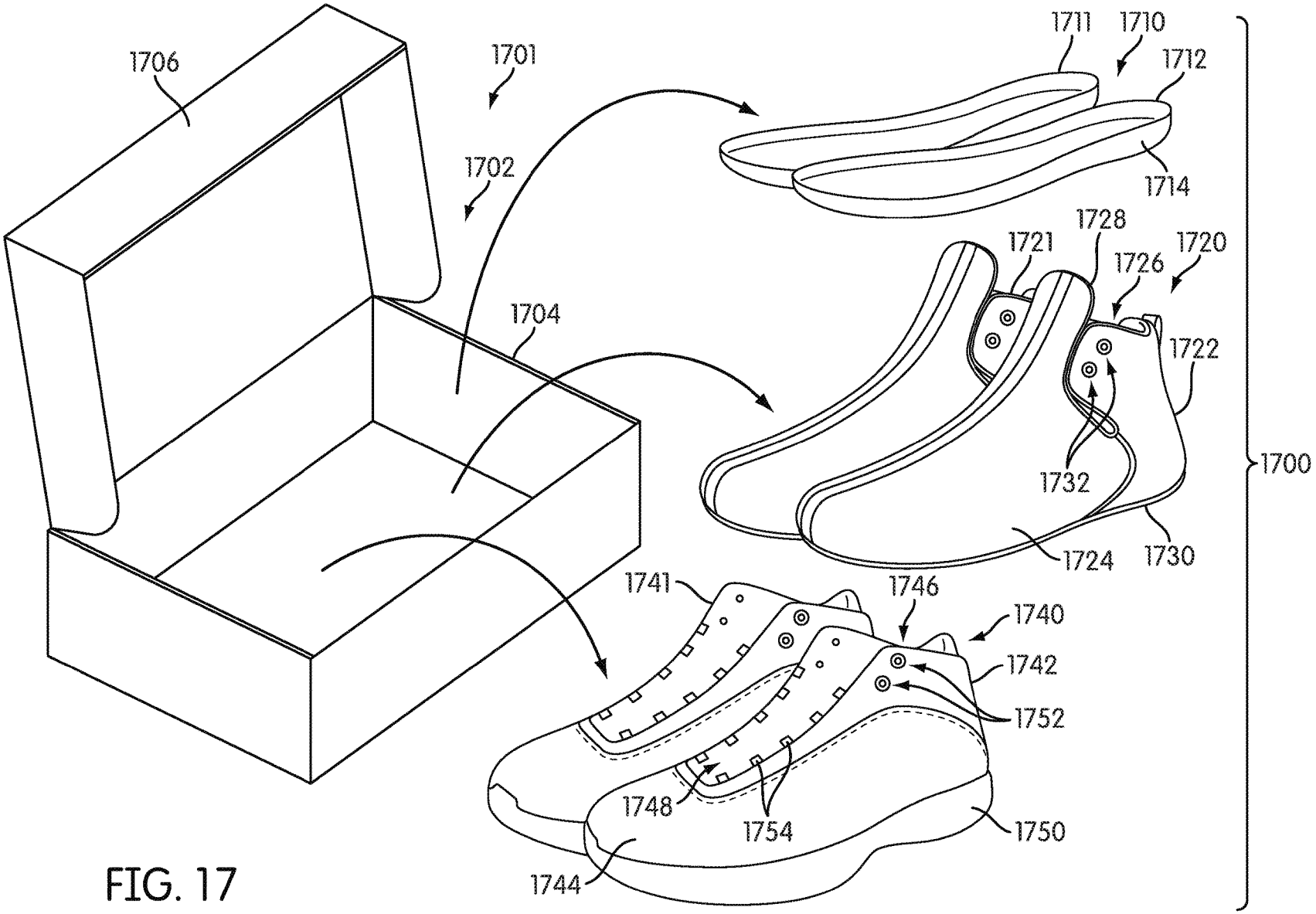
FIG. 17 is an isometric view of an embodiment of a footwear kit including a container and an interchangeable bootie and midsole insert system.
Figure 18:
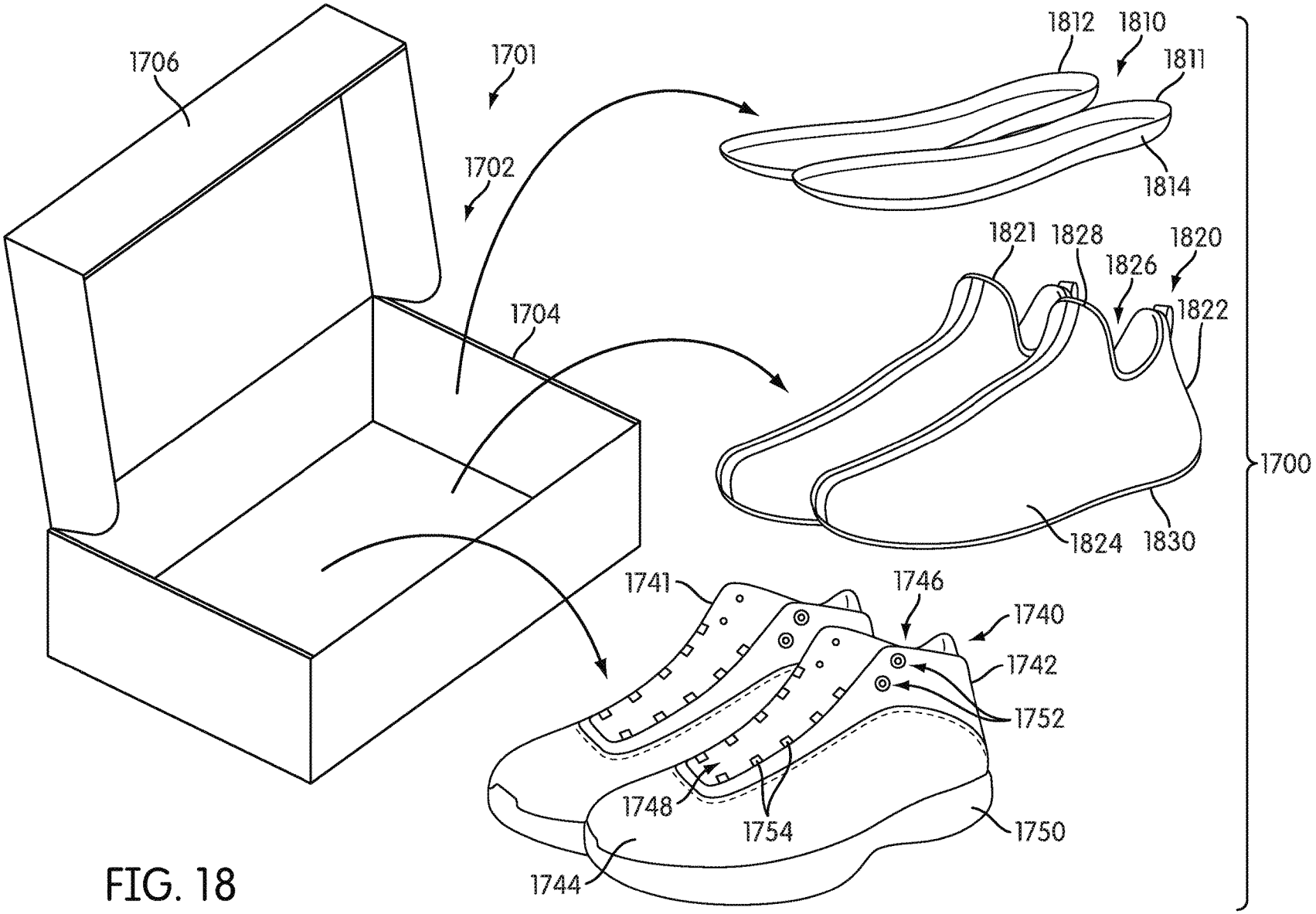
FIG. 18 is an isometric view of an embodiment of a footwear kit including a container and an interchangeable bootie and midsole insert system.

FIGS. 17 and 18 illustrate isometric views of kit of parts 1701, or simply kit 1701. In some cases, kit 1701 may comprise one or more articles of footwear, accessories for these articles and/or a container for storing the articles. In other cases, kit 1701 could include any other provisions not discussed below including, but not limited to: instructions, various kinds of media (such as CDs, DVDs, etc.), additional storage containers for storing articles and/or article accessories as well as any other provisions. In some embodiments, one or more provisions associated with kit 1701 may be substantially similar to those associated with kit 101, described above.

Kit 1701 may be offered for sale at a retail location, such as a retail store, kiosk, factory outlet, manufacturing store and/or through an online vendor. In some cases, the various parts of kit 1701 are sold together. In other cases, however, some parts of kit 1701 may be sold separately. As an example, the current embodiment describes a kit of parts including a pair of footwear and a pair of corresponding booties and a pair of insertable midsole portions. In some cases, a retailer could sell a kit including the footwear, the pair of booties, and the pair of insertable midsole portions and the retailer could also sell one or more pairs of booties and/or insertable midsole portions separately from kit 1701.

Kit 1701 may include container 1702. Container 1702 can be any type of container configured to store at least one article of footwear. In some cases, container 1702 may be a box. In an exemplary embodiment, container 1702 may be a shoebox that is configured to store footwear. In particular, container 1702 may have a generally rectangular shape and can include lower portion 1704 and lid 1706. In other embodiments, container 1702 could be a bag, sack or other type of container. In still other embodiments, the various items in kit 1701 may not be provided in a container.

In some embodiments, kit 1701 includes pair of footwear 1740 that includes first article of footwear 1741 and second article of footwear 1742. Generally, articles of footwear associated with kit 1701 can be any type of footwear. For clarity, the following detailed description discusses articles of footwear in the form of sports shoes, but it should be noted that in other embodiments any other type of footwear could be used including, but not limited to: hiking boots, soccer shoes, football shoes, sneakers, rugby shoes, basketball shoes, baseball shoes as well as other kinds of shoes. Articles of footwear associated with kit 1701 may also take the form of any non-athletic shoe, including, but not limited to, dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures. In some embodiments, pair of footwear 1740 may be substantially similar to pair of footwear 120, described above in reference to kit 101.

First article of footwear 1741 and second article of footwear 1742 may be oriented for a right foot and a left foot, respectively. For purposes of clarity, the following detailed description discusses second article of footwear 1742, but it will be understood that each of the features discussed for second article of footwear 1742 could also apply to first article of footwear 1741. Furthermore, second article of footwear 1742 may also be referred to as article 1742 throughout the remainder of this detailed description.

Article 1742 can include upper 1744. Generally, upper 1744 may be any type of upper. In particular, upper 1744 may have any design, shape, size and/or color. For example, in embodiments where article 1742 is a basketball shoe, upper 1744 could be a high top upper that is shaped to provide high support on an ankle. In embodiments where article 1742 is a running shoe, upper 1744 could be a low top upper. In the current embodiment, upper 1744 may be a mid-top type upper that can be used in basketball shoes as well as other types of footwear.

Upper 1744 can further include opening 1746 that provides entry for a foot into an interior cavity of upper 1744. In some cases, opening 1746 may be disposed at the ankle region of upper 1744. However, in other cases, opening 1746 could be disposed in any other region of upper 1744. Additionally, the size of opening 1746 may be controlled using lacing system 1748 with a lace (not shown).

Article 1742 can also include sole structure 1750. In some embodiments, sole structure 1750 may be configured to provide traction for article 1742. In addition to providing traction, sole structure 1750 may attenuate ground reaction forces when compressed between the foot and the ground during walking, running or other ambulatory activities. The configuration of sole structure 1750 may vary significantly in different embodiments to include a variety of conventional or non-conventional structures. In some cases, the configuration of sole structure 1750 can be configured according to one or more types of ground surfaces on which sole structure 1750 may be used. Examples of ground surfaces include, but are not limited to: natural turf, synthetic turf, dirt, as well as other surfaces.

Sole structure 1750 extends between the foot and the ground when article 1742 is worn. In different embodiments, sole structure 1750 may include different components. For example, sole structure 1750 may include an outsole, a midsole, and/or an insole. In some cases, one or more of these components may be optional. In an exemplary embodiment, sole structure 1750 may not include midsole support and midsole support may be provided by an insertable midsole portion, described in more detail below.

Kit 1701 may further include first pair of booties 1720. In this embodiment, first pair of booties 1720 may be configured as high-top booties extending high on an ankle of a foot of a user. First pair of booties 1720 may also be configured with one or more types of support systems described herein. First pair of booties 1720 includes first bootie 1721 and second bootie 1722. For purposes of clarity, second bootie 1722 is discussed in detail below, however, it will be understood that first bootie 1721 may be configured with substantially similar provisions and in some cases could be substantially identical to second bootie 1722.

Second bootie 1722 includes base layer 1724 that has the approximate shape of a foot. In some cases, base layer 1724 could be substantially flexible. In other cases, however, base layer 1724 could be configured to be partially rigid. Second bootie 1722 may also include opening 1726 for receiving a foot. In an exemplary embodiment, second bootie 1722 may include a tongue 1728. In some embodiments, article 1742 may be provided without a tongue attached to upper 1744. In this embodiment, tongue 1728 may provide cushioning to a top of a foot of a user when disposed within article 1742. In other embodiments, article 1742 may include a tongue and tongue 1728 of second bootie 1722 may provide additional cushioning.

In some embodiments, second bootie 1722 can also include a gripping layer 1730. Gripping layer 1730 may be more rigid than base layer 1724 and can help to provide traction for second bootie 1722 when inserted within article 1742. In an exemplary embodiment, gripping layer 1730 may be made of a plastic material. In other embodiments, however, gripping layer 1730 may be more flexible and may be made of a softer material, including fabric or leather materials.

In an exemplary embodiment, kit 1701 may further include first pair of insertable midsole portions 1710. In an exemplary embodiment, first pair of insertable midsole portions 1710 can be used with booties that are inserted into articles without any other kind of midsole support. In other cases, first pair of insertable midsole portions 1710 can be used to reinforce midsole support already provided inside an article of footwear. In this embodiment, first pair of insertable midsole portions 1710 may be configured to be disposed within a bootie to provide cushioning and/or support to a foot of a user when disposed within an article. First pair of insertable midsole portions 1710 may also be configured with a cushioning system including one or more types of cushioning elements described herein. First pair of insertable midsole portions 1710 includes first midsole insert 1711 and second midsole insert 1712. For purposes of clarity, second midsole insert 1712 is discussed in detail below, however, it will be understood that first midsole insert 1711 may be configured with substantially similar provisions and in some cases could be substantially identical to second midsole insert 1712.

Second midsole insert 1712 includes a first midsole configuration 1714 that has the approximate shape of a foot. In an exemplary embodiment, first midsole configuration 1714 may include a cushioning system, including one or more cushioning elements, as described above. In one embodiment, first midsole configuration 1714 may be associated with a cushioning system that is configured for a particular type of cushioning and/or shock absorption. For example, in some cases, first midsole configuration 1714 may be associated with a cushioning system that is configured to provide a greater level of cushioning and/or shock absorption to a substantial majority of a foot of a user when disposed within an article. In other cases, different midsole configurations may be associated with different cushioning systems that are configured to provide different levels of cushioning and/or shock absorption to a foot of a user. In addition, in still other cases, cushioning systems may be further configured to provide targeted cushioning and/or shock absorption to one or more portions of a foot of a user.

In an exemplary embodiment, kit 1701 may be provided with different booties and/or different insertable midsole portions that are configured to be used with pair of footwear 1740, described above. As shown in FIG. 18, kit 1701 may be substantially similar to the embodiment of kit 1701 shown in FIG. 17. In this embodiment, kit 1701 includes a second pair of booties 1820. In this embodiment, second pair of booties 1820 may be configured as mid-top booties extending below an ankle of a foot of a user. Second pair of booties 1820 may also be configured with one or more types of support systems described herein. In an exemplary embodiment, second pair of booties 1820 may be provided with kit 1701 to provide a different type of support system than first pair of booties 1720.

Second pair of booties 1820 includes first bootie 1821 and second bootie 1822. For purposes of clarity, second bootie 1822 is discussed in detail below, however, it will be understood that first bootie 1821 may be configured with substantially similar provisions and in some cases could be substantially identical to second bootie 1822.

Second bootie 1822 includes base layer 1824 that has the approximate shape of a foot. In some cases, base layer 1824 could be substantially flexible. In other cases, however, base layer 1824 could be configured to be partially rigid. Second bootie 1822 may also include opening 1826 for receiving a foot. In an exemplary embodiment, second bootie 1822 may include a tongue 1828. In some embodiments, article 1742 may be provided without a tongue attached to upper 1744. In this embodiment, tongue 1828 may provide cushioning to a top of a foot of a user when disposed within article 1742. In other embodiments, article 1742 may include a tongue and tongue 1828 of second bootie 1822 may provide additional cushioning.

In some embodiments, second bootie 1822 can also include a gripping layer 1830. Gripping layer 1830 may be more rigid than base layer 1824 and can help to provide traction for second bootie 1822 when inserted within article 1742. In an exemplary embodiment, gripping layer 1830 may be made of a plastic material. In other embodiments, however, gripping layer 1830 may be more flexible and may be made of a softer material, including fabric or leather materials.

In an exemplary embodiment, kit 1701 may further include second pair of insertable midsole portions 1810. In an exemplary embodiment, second pair of insertable midsole portions 1810 can be used with booties that are inserted into articles without any other kind of midsole support. In other cases, second pair of insertable midsole portions 1810 can be used to reinforce midsole support already provided inside an article of footwear. In this embodiment, second pair of insertable midsole portions 1810 may be configured to be disposed within a bootie to provide cushioning and/or support to a foot of a user when disposed within an article. Second pair of insertable midsole portions 1810 may also be configured with a cushioning system including one or more types of cushioning elements described herein. In an exemplary embodiment, second pair of insertable midsole portions 1810 may be provided with kit 1701 to provide a different type of cushioning system than first pair of insertable midsole portions 1710.

Second pair of insertable midsole portions 1810 includes first midsole insert 1811 and second midsole insert 1812. For purposes of clarity, second midsole insert 1812 is discussed in detail below, however, it will be understood that first midsole insert 1811 may be configured with substantially similar provisions and in some cases could be substantially identical to second midsole insert 1812.

Second midsole insert 1812 includes a second midsole configuration 1814 that has the approximate shape of a foot. In an exemplary embodiment, second midsole configuration 1814 may include a cushioning system, including one or more cushioning elements, as described above. In one embodiment, second midsole configuration 1814 may be associated with a cushioning system that is configured for a particular type of cushioning and/or shock absorption. For example, in some cases, second midsole configuration 1814 may be associated with a cushioning system that is configured to provide a lower level of cushioning and/or shock absorption and/or to provide targeted cushioning to a particular portion of a foot of a user when disposed within an article. In other cases, different midsole configurations may be associated with different cushioning systems that are configured to provide different levels of cushioning and/or shock absorption to a foot of a user. In addition, in still other cases, cushioning systems may be further configured to provide targeted cushioning and/or shock absorption to one or more portions of a foot of a user. In an exemplary embodiment, second midsole configuration 1814 may provide a different level of cushioning and/or may provide different targeted cushioning to one or more portions of a foot than first midsole configuration 1714.

With this arrangement, kit 1701 may be provided with one of first pair of booties 1720 or second pair of booties 1820 and one of first pair of insertable midsole portions 1710 or second pair of insertable midsole portions 1810 to configure kit 1701 with different types of support and/or cushioning. For example, a kit including first pair of booties 1720 and first pair of insertable midsole portions 1710 for use with pair of footwear 1740 may be configured to provide a greater level of support and cushioning. Similarly, a kit including second pair of booties 1820 and second pair of insertable midsole portions may be configured to provide a lower level of support and cushioning, but at a reduced weight than the configuration that provides greater support and cushioning. In other embodiments, different combinations of booties and/or insertable midsole portions may be provided within kit 1701 to configure kit 1701 with other desired types or levels of support and cushioning.

Figure 19:
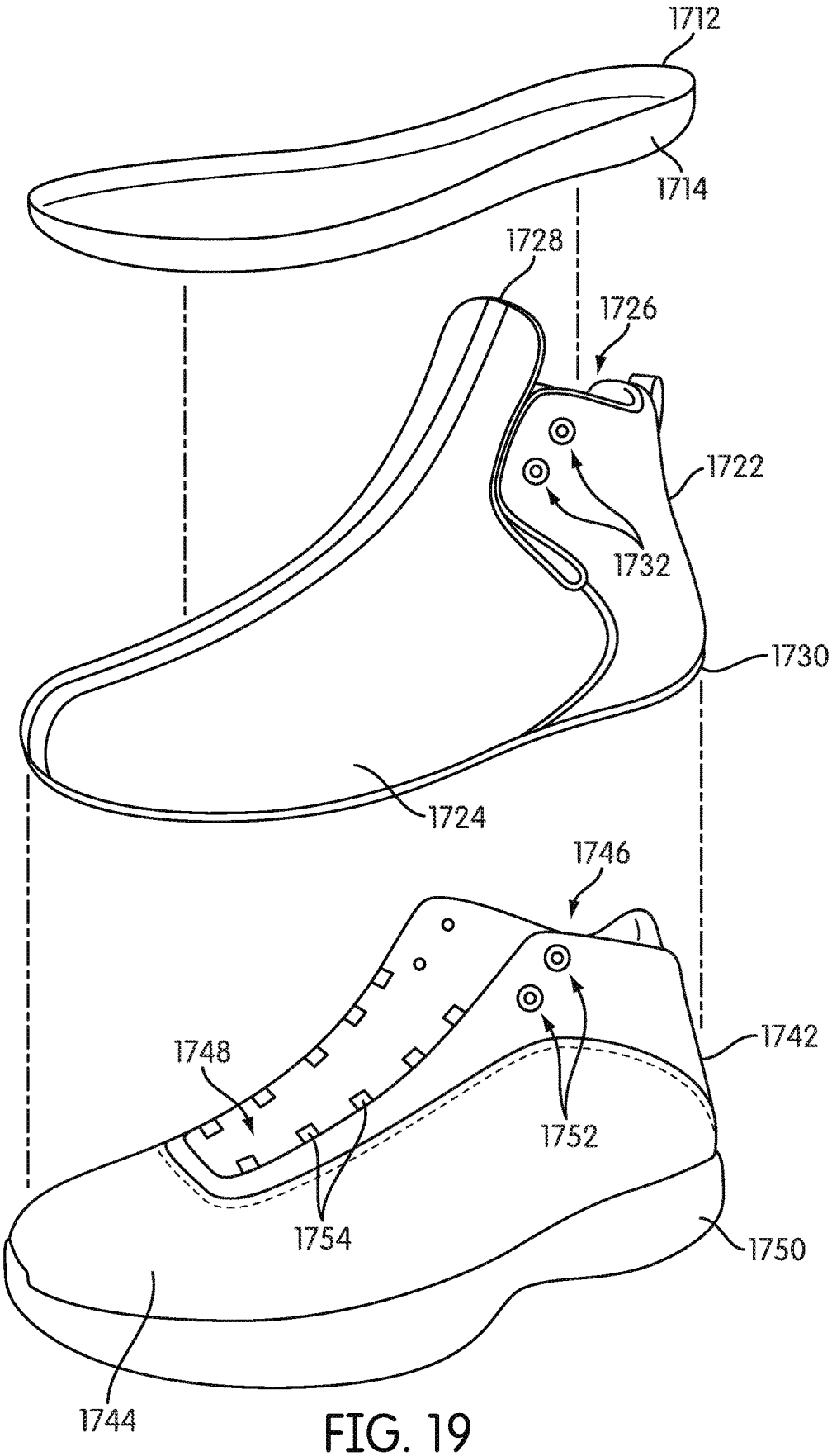
FIG. 19 is an exploded view of an article of footwear with an interchangeable bootie and midsole insert system.

Referring now to FIG. 19, an exploded view of article of footwear 1742 with second bootie 1722 of first pair of booties 1720 and second midsole insert 1712 of first pair of insertable midsole portions 1710 is illustrated. It should be understood that other booties and/or insertable midsole portions may be similarly arranged to be disposed within an article. In this embodiment, second midsole insert 1712 is configured to be disposed within second bootie 1722. In an exemplary embodiment, second midsole insert 1712 may be inserted into second bootie 1722 through opening 1726. With second midsole insert 1712 disposed within second bootie 1722, second midsole insert 1712 may lie generally flat against a bottom of the interior of second bootie 1722 and above gripping layer 1730.

Second bootie 1722 having second midsole insert 1712 disposed within is configured to be disposed within article 1742. In an exemplary embodiment, second bootie 1722 may be inserted into article 1742 through opening 1746. In addition, in this embodiment, article 1742 is configured with lacing system 1748 that does not include a tongue. Instead, tongue 1728 associated with second bootie 1722 may provide cushioning to a top of a foot of a user when disposed within article 1742. With this arrangement, the opening in upper 1744 associated with lacing system 1748 may assist with inserting second bootie 1722 within article 1742. It should be understood that while the current embodiment has been described as having second midsole insert 1712 disposed within second bootie 1722 before second bootie 1722 is disposed within article 1742, second midsole insert 1712 may instead be disposed within second bootie 1722 after second bootie 1722 has already been disposed within article 1742.

In some embodiments, lacing system 1748 of article 1742 may be provided with one or more lace receiving members that are configured to assist with securing second bootie 1722 within article 1742 and may be used to tighten assembled article 1742 around a foot of user. In this embodiment, lacing system 1748 includes a first group of lace receiving members 1752 disposed adjacent to opening 1746 on article 1742. In some cases, first group of lace receiving members may include eyelets or eyestays configured to receive a lace. Lacing system 1748 may further include a second group of lace receiving members 1754. Second group of lace receiving members 1754 may be disposed on opposite sides of upper 1744 spanning the opening in upper 1744 associated with lacing system 1748. With this arrangement, a lace, such as lace 141, described above, may be used with lacing system 1748 and one or more of first group of lace receiving members 1752 and second group of lace receiving members 1748 to secure second bootie 1722 within article 1742 and/or to tighten article 1742 around a foot of a user.

In an exemplary embodiment, second bootie 1722 may be provided with one or more provisions that are configured to further associate second bootie 1722 with article 1742. In this embodiment, second bootie 1722 includes a pair of bootie lace receiving members 1732. Bootie lace receiving members 1732 may be disposed adjacent to opening 1726 on second bootie 1722. It should also be understood that second bootie 1722 may further include a second pair of bootie lace receiving members disposed on an opposite side of second bootie 1722 that are substantially similar to bootie lace receiving members 1732. In an exemplary embodiment, bootie lace receiving members 1732 may be configured to align with first group of lace receiving members 1752 disposed in an approximately similar location on article 1742. With this arrangement, a lace may be disposed through one or more of bootie lace receiving members 1732 and first group of lace receiving members 1752 to associate second bootie 1722 and article 1742. In other embodiments, a bootie may include additional provisions configured to associate a bootie and an article, including additional lace receiving members that are configured to associate with a lace on a lacing system of an article.

Figure 20:
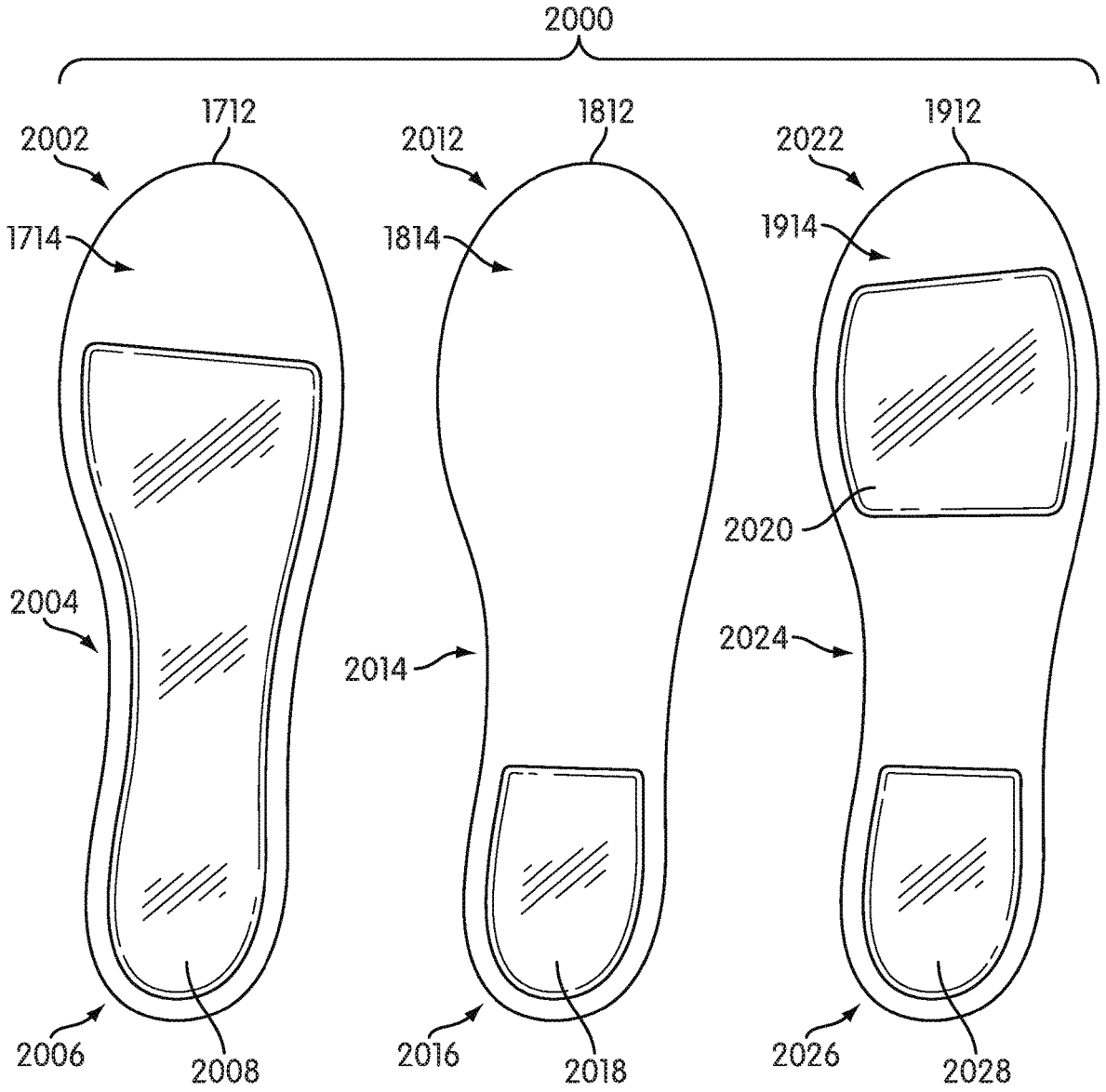
FIG. 20 is a top down view of an embodiment of three midsole inserts having cushioning systems for use with a bootie and article of footwear.

Referring now to FIG. 20, a midsole insert system 2000 is configured to provide customizable cushioning and/or shock absorption for an article of footwear. Midsole insert system 2000 includes multiple insertable midsole portions that provide targeted cushioning and/or shock absorption to various regions of the foot. In an exemplary embodiment, midsole insert system 2000 may include three insertable midsole portions. Each insertable midsole portion may be configured with a different midsole configuration, including cushioning systems having different types and/or locations of cushioning elements. In some embodiments, cushioning elements may be provided as inserts that incorporate various kinds of bladders and/or fluid chambers. Generally, any kind of fluid bladder and/or fluid chamber known in the art could be used, including one or more of the fluid bladders and/or fluid chambers described above.

In this embodiment, midsole insert system 2000 includes first midsole configuration 1714 that is associated with second midsole insert 1712 of first pair of insertable midsole portions 1710. First midsole configuration 1714 may include a cushioning system having a first cushioning element 2008. In this embodiment, first cushioning element 2008 extends from heel portion 2006 of second midsole insert 1712 through midfoot portion 2004 and partially into forefoot portion 2002. With this arrangement, first midsole configuration 1714 with a cushioning system that includes first cushioning element 2008 can be configured to provide cushioning and/or shock absorption to a majority of a foot of a user when second midsole insert 1712 is disposed within a bootie and an article of footwear.

In some embodiments, a midsole configuration for a midsole insert may include a cushioning system having one or more cushioning elements that are disposed on one or more discrete portions of a midsole insert. In an exemplary embodiment, midsole insert system 2000 includes second midsole configuration 1814 that is associated with second midsole insert 1812 of second pair of insertable midsole portions 1810. Second midsole configuration 1814 may include a cushioning system having a second cushioning element 2018. In this embodiment, second cushioning element 2018 is disposed in heel portion 2016 of second midsole insert 1812. With this arrangement, second cushioning element 2018 can be configured to provide cushioning and/or shock absorption to a heel of a foot of a user when second midsole insert 1812 is disposed within a bootie and an article of footwear. In this embodiment, second midsole arrangement 1814 is associated with a cushioning system that does not include any separate cushioning elements disposed in a forefoot portion 2012 and/or a midfoot portion 2014. However, in other embodiments, additional cushioning elements can be provided.

In an exemplary embodiment, midsole insert system 2000 includes a third midsole configuration 1914 that is associated with a midsole insert 1912 that is part of a third pair of insertable midsole portions. Third midsole configuration 1914 may include a cushioning system including multiple cushioning elements. In this embodiment, third midsole configuration 1914 includes a cushioning system having a third cushioning element 2020 and a fourth cushioning element 2028. In this embodiment, third cushioning element 2020 is disposed in a forefoot portion 2022 of midsole insert 1912 and fourth cushioning element 2028 is disposed in a heel portion 2026 of midsole insert 1912. With this arrangement, third cushioning element 2020 can be configured to provide cushioning and/or shock absorption to a ball of a foot of a user and fourth cushioning element 2028 can be configured to provide cushioning and/or shock absorption to a heel of a foot of a user when midsole insert 1912 is disposed within a bootie and an article of footwear. In this embodiment, third midsole arrangement 1914 is associated with a cushioning system that does not include any separate cushioning elements disposed in a midfoot portion 2024. However, in other embodiments, additional cushioning elements can be provided.

In other embodiments, midsole insert system 2000 may be provided with additional insertable midsole portions that include various types of cushioning systems and/or cushioning elements. For example, in another embodiment, a pair of insertable midsole portions may be provided with a cushioning system that does not include any separate cushioning elements. Other midsole configurations using one or more of the cushioning systems disclosed herein may be provided for insertable midsole portions to provide targeted levels of cushioning and/or shock absorption to various portions of a foot of a user.

Figure 21:
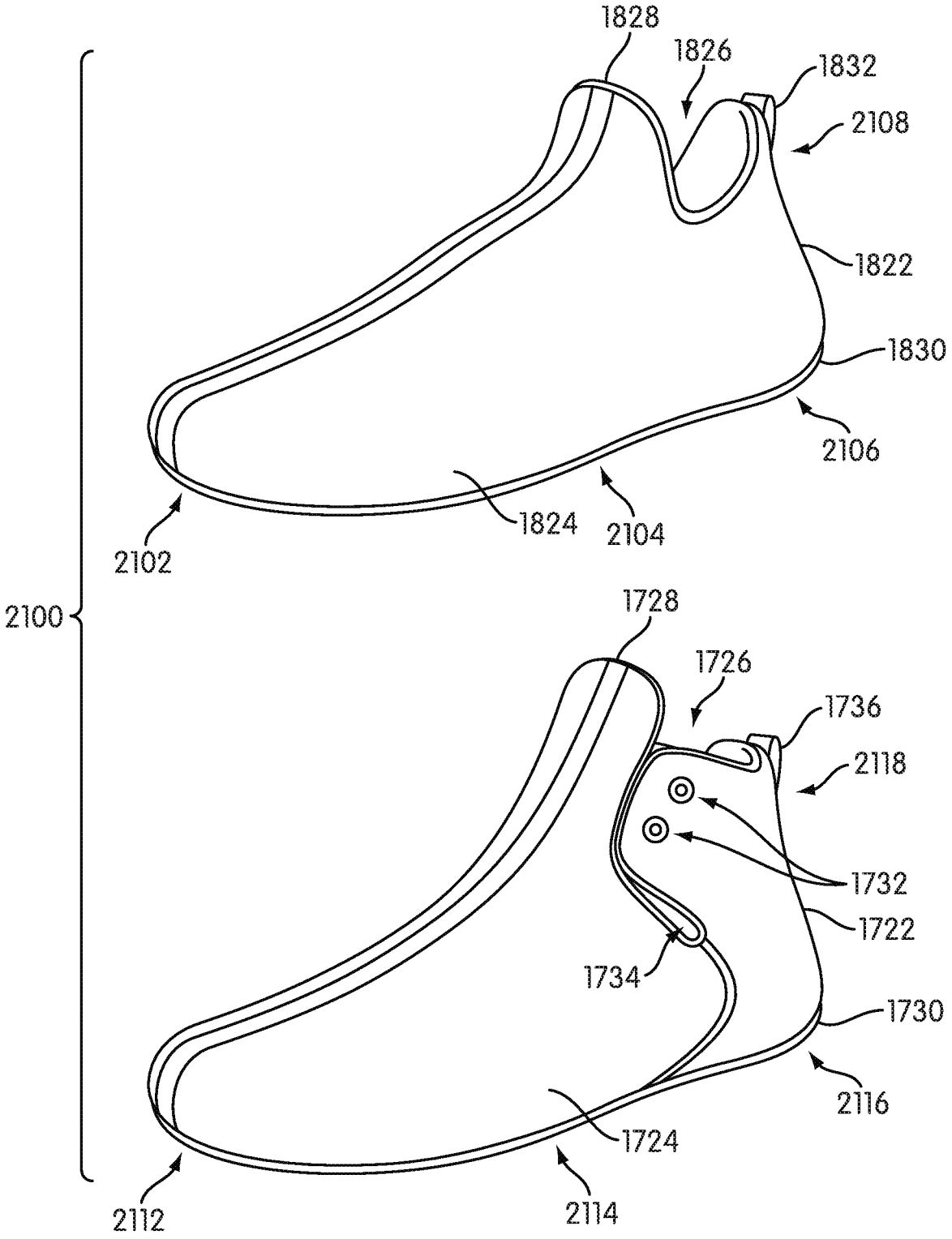
FIG. 21 is an isometric view of an embodiment of two booties for use with a midsole insert and an article of footwear.

Referring now to FIG. 21, an interchangeable bootie system 2100 is configured to provide customizable support for an article of footwear. Interchangeable bootie system 2100 includes multiple interchangeable booties that provide targeted support to various regions of the foot, as described in the embodiments above. In an exemplary embodiment, interchangeable bootie system 2100 may include two types of interchangeable booties. In this embodiment, interchangeable bootie system 2100 includes second bootie 1722 of first pair of booties 1720 and second bootie 1822 of second pair of booties 1820.

In this embodiment, second bootie 1822 may be configured with base layer 1824 that is configured to enclose a foot of a user from a forefoot portion 2102 through a midfoot portion 2104 and to a heel portion 2106. Second bootie 1822 may be configured as a mid-top bootie that includes an ankle portion 2108 that extends to approximately an ankle of a foot of a user. In addition to the components of second bootie 1822 described above, second bootie 1822 may also include provisions that are configured to assist a user with inserting second bootie 1822 within an article. In this embodiment, second bootie 1822 includes a heel pull 1832. Heel pull 1832 may be disposed near opening 1826 and may allow a user to grab hold of second bootie 1822.

In this embodiment, second bootie 1722 may be configured with base layer 1724 that is configured to enclose a foot of a user from a forefoot portion 2112 through a midfoot portion 2114 and to a heel portion 2116. Second bootie 1722 may be configured as a high-top bootie that includes an ankle portion 2118 that extends over an ankle of a foot of a user. In addition to the components of second bootie 1722 described above, second bootie 1722 may also include provisions that are configured to assist a user with inserting a foot into second bootie 1722 and/or inserting second bootie 1722 within an article. In this embodiment, second bootie 1722 includes a side opening 1734. Side opening 1734 may be an opening in a portion of base layer 1724 between midfoot portion 2114 and heel portion 2116 that provides extra room for a user to open second bootie 1722 when inserting a foot inside. A second side opening that is substantially similar to side opening 1734 may be disposed on an opposite of second bootie 1722. In addition, second bootie 1722 may also include a heel pull 1736. Heel pull 1736 may be disposed near opening 1726 and may allow a user to grab hold of second bootie 1722.

Figure 22:
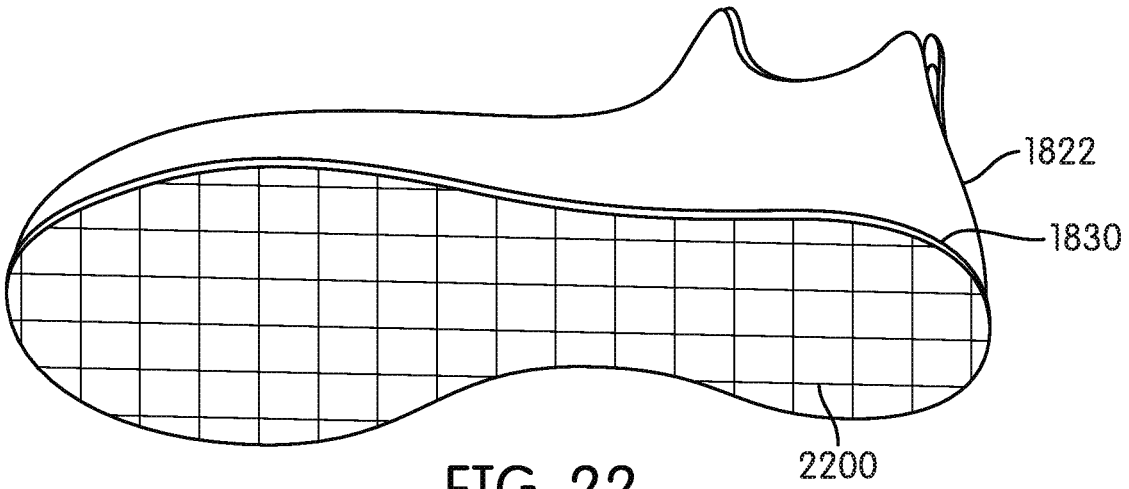
FIG. 22 is an isometric view of the underside of an embodiment of a bootie for use with a midsole insert and an article of footwear.

Referring now to FIG. 22, an underside of bootie 1822 showing gripping layer 1830 is illustrated. As described above, a gripping layer may be disposed on a bootie to help provide traction for a bootie when inserted within an article. In this embodiment, gripping layer 1830 may include textured elements 2200 on a bottom surface of second bootie 1822. Textured elements 2200 may be configured to provide traction to a bootie within an interior of an article. With this arrangement, second bootie 1822 may be made to resist significant movement or sliding within an article. In other embodiments, textured elements 2200 and/or gripping layer 1830 may be optional and may be omitted. In addition, other embodiments of a bootie, including second bootie 1722 of second pair of booties 1720, may be provided with substantially similar gripping layers with textured elements on a bottom surface.

Figure 23:
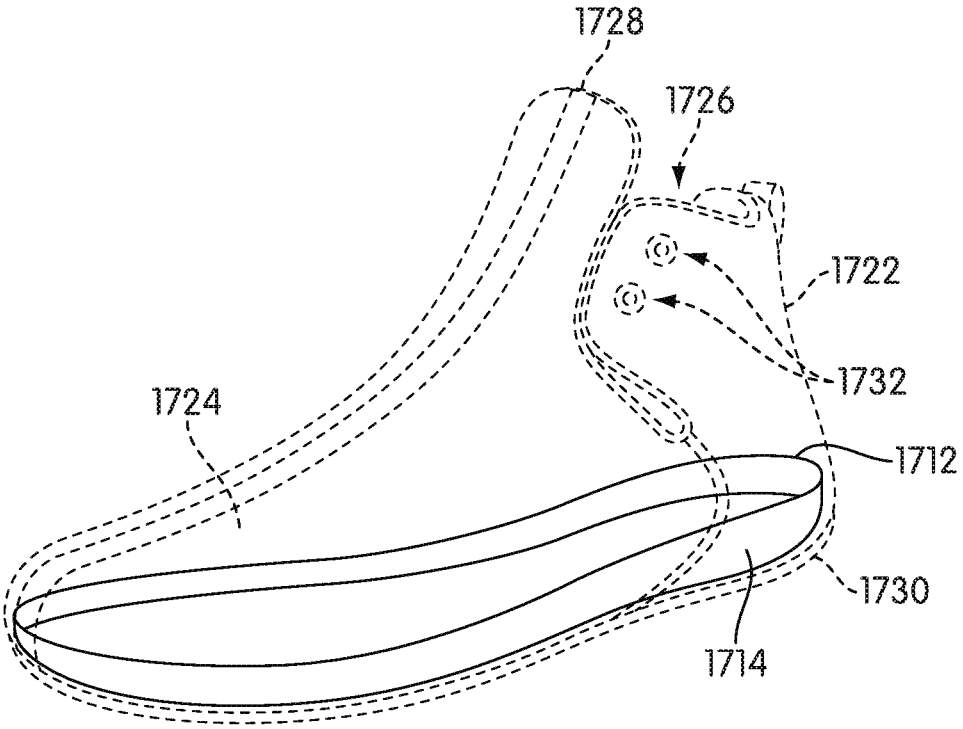
FIG. 23 is an isometric view of an embodiment of a midsole insert with a cushioning system inserted into a bootie, where the bootie is shown in phantom.
Figure 24:
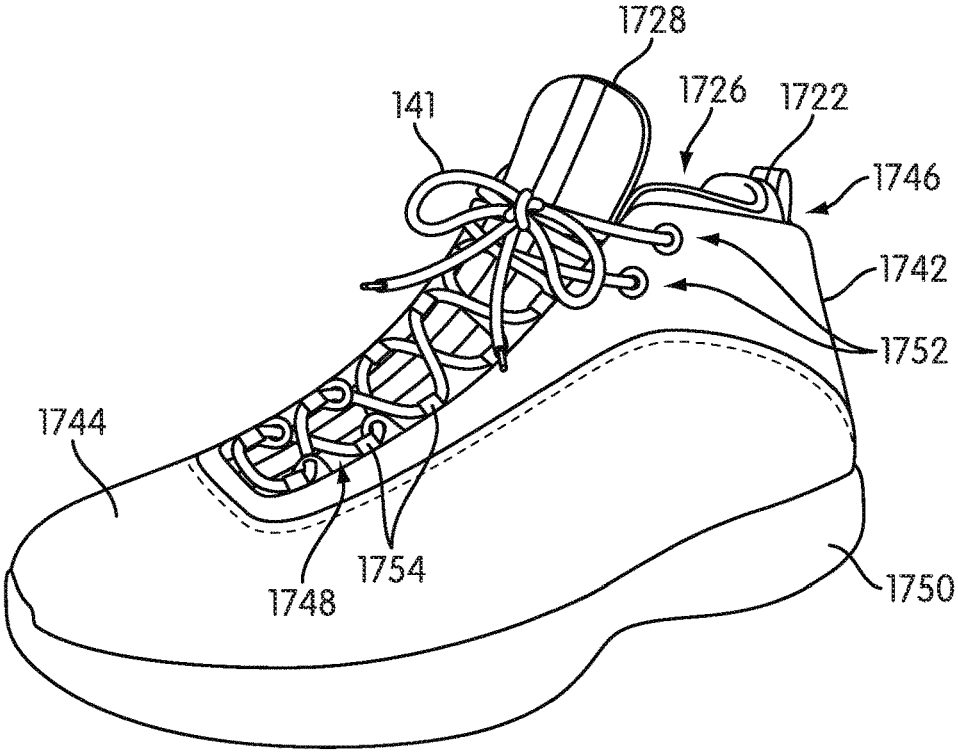
FIG. 24 is an isometric view of an embodiment of a bootie including a midsole insert with a cushioning system inserted into an article of footwear.
Figure 25:
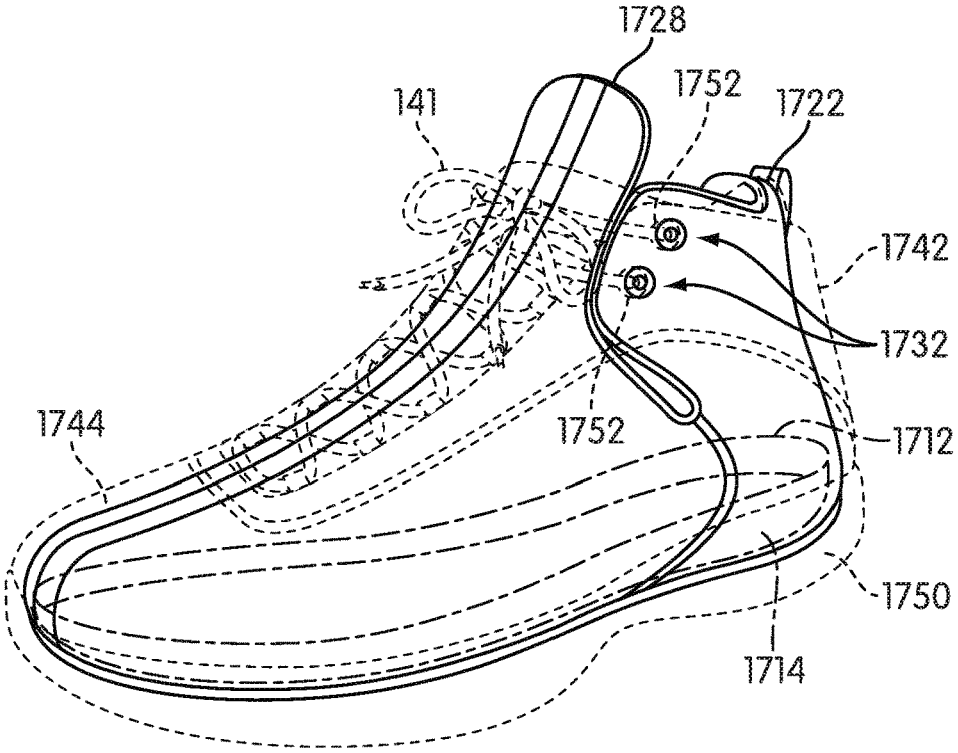
FIG. 25 is an isometric view of an embodiment of a bootie including a midsole insert with a cushioning system inserted into an article of footwear, where the article of footwear and the midsole insert are shown in phantom.

FIGS. 23 through 25 illustrate isometric views of an embodiment of second bootie 1722 of first pair of booties 1720 including second midsole insert 1712 with first midsole configuration 1714 assembled with article of footwear 1742. In this embodiment, article of footwear 1742 is a mid-top article that is configured with a lacing system 1748 that includes lace 141, as described above. For purposes of illustration, second bootie 1722 is shown in phantom in FIG. 23 and article 1742 and second midsole insert 1712 are shown in phantom in FIG. 25.

Referring to FIG. 23, second midsole insert 1712 with first midsole configuration 1714 may be inserted through opening 1726 in second bootie 1722. With second midsole insert 1712 disposed within second bootie 1722, second midsole insert 1712 may lie generally flat against a bottom of the interior of second bootie 1722 and above gripping layer 1730.

Referring now to FIGS. 24 and 25, second bootie 1722 having second midsole insert 1712 disposed within is shown disposed within assembled article 1742. In an exemplary embodiment, second bootie 1722 may be inserted into article 1742 through opening 1746. In addition, in this embodiment, article 1742 is configured with lacing system 1748 that does not include a tongue. Instead, tongue 1728 associated with second bootie 1722 may provide cushioning to a top of a foot of a user when disposed within article 1742. With this arrangement, the opening in upper 1744 associated with lacing system 1748 may assist with inserting second bootie 1722 within article 1742. It should be understood that while the current embodiment has been described as having second midsole insert 1712 disposed within second bootie 1722 before second bootie 1722 is disposed within article 1742, second midsole insert 1712 may instead be disposed within second bootie 1722 after second bootie 1722 has already been disposed within article 1742.

In this embodiment, lace 141 is disposed through one or more of first group of lace receiving members 1752 and second group of lace receiving members 1748 to secure second bootie 1722 within article 1742 and/or to tighten article 1742 around a foot of a user. In addition, in this embodiment, bootie lace receiving members 1732 are disposed adjacent to opening 1726 on second bootie 1722 and are aligned with first group of lace receiving members 1752 disposed in an approximately similar location on article 1742. With this arrangement, lace 141 may be disposed through one or more of bootie lace receiving members 1732 and first group of lace receiving members 1752 to associate second bootie 1722 and article 1742.

Figure 26:
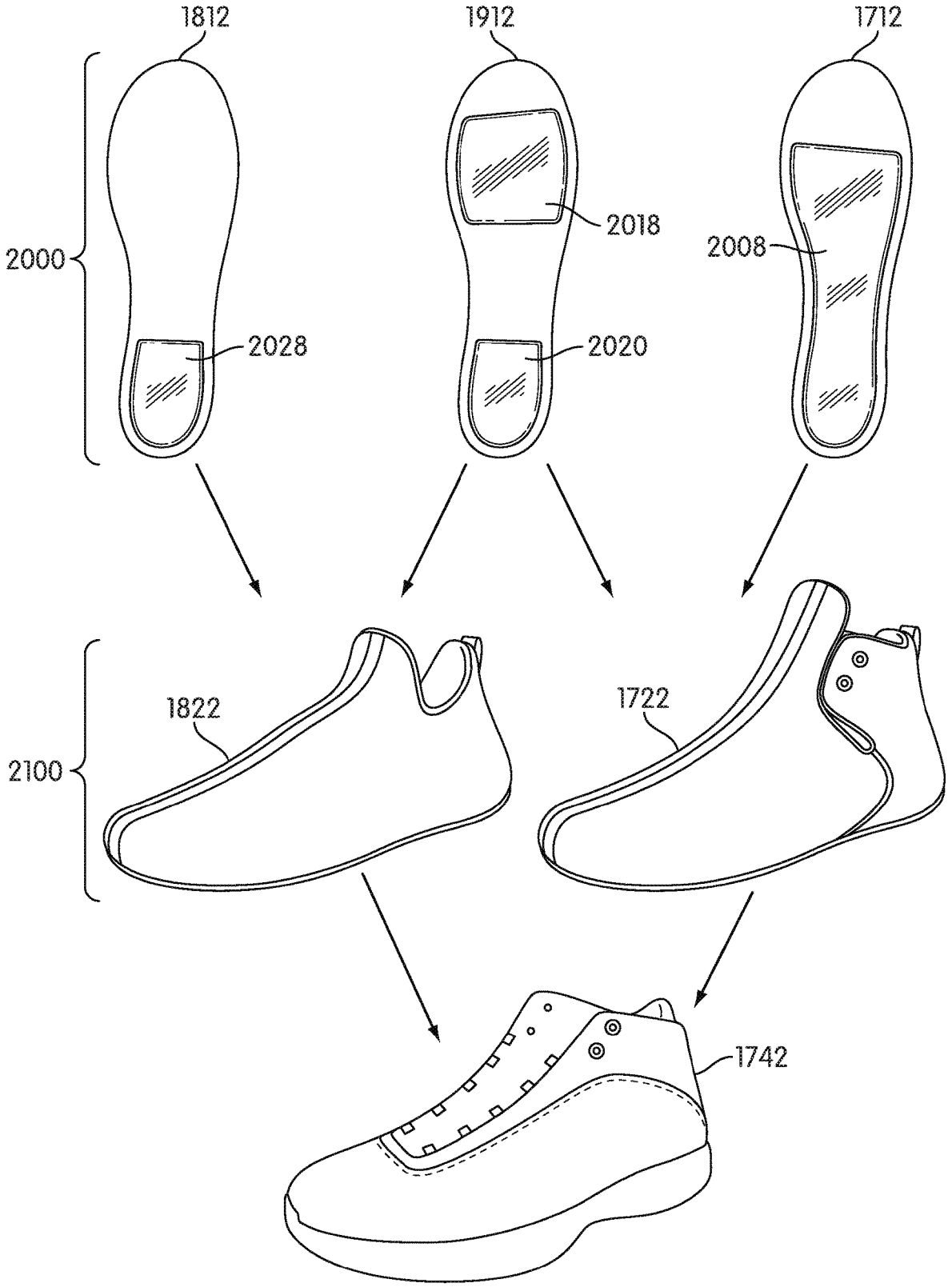
FIG. 26 is a schematic view of an embodiment of an interchangeable bootie and midsole insert system including three midsole inserts with differing types of cushioning systems and two booties for use with an article of footwear.

As illustrated in FIG. 26, an interchangeable bootie and midsole insert system may be used to allow a user to customize the type of support and the type of cushioning and/or shock absorption provided by an article of footwear. For example, a user may select a midsole insert from midsole insert system 2000 and a bootie from interchangeable bootie system 2100 for use with article 1742. In one embodiment, kit 1701, discussed above, may be configured to provide article 1742 with a combination of midsole inserts and booties that are configured to provide less support and/or cushioning in order to reduce weight of article 1742. In this embodiment, second midsole insert 1812 having second midsole configuration 1814 including second cushioning element 2028 may be combined with second bootie 1822 for use in article 1742. Similarly, in another embodiment, kit 1701 may be configured to provide article 1742 with a combination of midsole inserts and booties that are configured to provide greater support and/or cushioning to article 1742. In this embodiment, second midsole insert 1712 having a first midsole configuration 1714 including first cushioning element 2008 may be combined with second bootie 1722 for use in article 1742.

In some embodiments, additional components for use with kit 1701 may be provided to change the support and/or cushioning provided to a foot of a user within article 1742. In an exemplary embodiment, an additional insertable midsole portion having third midsole configuration 1914 may be provided separate from kit of parts 1701. In one embodiment, a third pair of insertable midsole portions including midsole portion 1912 and a substantially similar midsole portion for the opposite foot, both having third midsole configuration 1914, may be provided as a separate package at a retailer. Third midsole configuration 1914 may include a cushioning system having multiple cushioning elements, including third cushioning element 2020 and fourth cushioning element 2028, as described above. With this arrangement, third midsole configuration 1914 can be configured to provide cushioning and/or shock absorption to a ball of a foot and a heel of a foot of a user when midsole insert 1912 is disposed within a bootie and an article of footwear.

In this embodiment, third midsole configuration 1914 is configured to provide a greater level of cushioning and/or shock absorption to a foot of a user than second midsole configuration 1814, but also to provide a lower level of cushioning and/or shock absorption to a foot of a user than first midsole configuration 1714. By providing a third pair of insertable midsole portions with third midsole configuration 1914 as a separate package, a user may modify kit of parts 1701 containing second midsole insert 1812, second bootie 1822 and article 1742 to increase the level of cushioning and/or shock absorption by replacing second midsole insert 1812 with midsole insert 1912. Similarly, a user may modify kit of parts 1701 containing second midsole insert 1712, second bootie 1722 and article 1742 to decrease the level of cushioning and/or shock absorption by replacing second midsole insert 1812 with midsole insert 1912. In other embodiments, however, third pair of insertable midsole portions with third midsole configuration 1914 may be provided as a second pair of midsole inserts with kit 1701.

This arrangement reduces the need for a user to purchase different pairs of footwear for different support and cushioning needs. Instead, the user can simply interchange one insertable midsole portion having one type of cushioning system with another insertable midsole portion having a different kind of cushioning system. Additionally, a user can interchange one bootie having one type of support system with another bootie having a different kind of support system. By allowing a user to select a particular bootie having a particular support system and also allowing a user to select a particular insertable midsole portion having a particular cushioning system, the present embodiments provide an article of footwear with customizable and targeted support and cushioning.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A kit of parts, comprising:

an article of footwear;

a first bootie including:

a first base layer that has the approximate shape of a foot, wherein the first base layer includes a forefoot portion, a heel portion, and a midfoot portion disposed between the forefoot portion and the heel portion, wherein the forefoot portion, heel portion, and midfoot portion together cover a top portion of a wearer's foot, including a wearer's toes, and a heel of the wearer's foot when the first bootie is worn by the wearer;

a first support system that includes a plurality of threads collected into a first thread group, wherein the first thread group extends from a medial side of the heel portion of the first bootie upwardly into an ankle portion of the first bootie and around a forward portion of a throat of the first bootie; and a first integrated midsole portion extending from the forefoot portion through the midfoot portion to the heel portion and is secured to the first base layer, wherein the first integrated midsole portion is more rigid than the first base layer, wherein the first bootie is configured to be inserted into the article of footwear;

a second bootie including:

a second base layer that has the approximate shape of a foot, wherein the second base layer includes a forefoot portion, a heel portion, and a midfoot portion disposed between the forefoot portion and the heel portion, wherein the forefoot portion, heel portion, and midfoot portion together cover the top portion of the wearer's foot, including the wearer's toes, and the heel of the wearer's foot when the second bootie is worn by the wearer; and a second integrated midsole portion extending from the forefoot portion through the midfoot portion to the heel portion and is secured to the second base layer, wherein the second integrated midsole portion is more rigid than the second base layer, wherein the second bootie is configured to be inserted into the article of footwear;

wherein the first integrated midsole portion includes a first targeted cushioning system to provide cushioning and shock absorbency for an ankle and the heel of the wearer's foot, the first targeted cushioning system comprising:

a first targeted cushioning disposed on the ankle portion and the heel portion of the first bootie and targeted towards the ankle portion and the heel portion, and a wrap portion that wraps around and encircles an ankle of the wearer when the wearer's foot is inserted within the first bootie and the second integrated midsole includes a second targeted cushioning system to provide cushioning and shock absorbency for a bottom of the wearer's foot, the second targeted cushioning system comprising a second targeted cushioning disposed on an arch portion and the midfoot portion of the second bootie and targeted towards the arch portion and the midfoot portion to support an arch of the wearer's foot when the wearer's foot is inserted within the second bootie.

2. The kit of parts according to claim 1, wherein the first targeted cushioning system comprises a cushioning element disposed at a portion of the first integrated midsole portion to provide targeted cushioning to the first portion of the article of footwear.

3. The kit of parts according to claim 2, wherein the second targeted cushioning system comprises at least two cushioning elements disposed at a first portion of the second integrated midsole portion and a second portion of the second integrated midsole portion.

4. The kit of parts according to claim 3, wherein at least one of the first portion of the second integrated midsole portion and the second portion of the second integrated midsole portion provide targeted cushioning to the second portion of the article of footwear.

5. The kit of parts according to claim 3, wherein the first portion of the second integrated midsole portion is at the arch portion and wherein the second portion of the second integrated midsole portion is at the midfoot portion.

6. The kit of parts according to claim 1, wherein the first support system provides support to a third portion of the article of footwear and wherein the second bootie includes a second support system to provide support to a fourth portion of the article of footwear; and wherein the third portion is different than the fourth portion.

7. The kit of parts according to claim 6, wherein the third portion is one of an ankle portion and a midfoot portion.

8. The kit of parts according to claim 5, wherein fourth portion is one of a forefoot portion and a midfoot portion.

9. An interchangeable bootie system, comprising:

an article of footwear;

a group of booties;

each bootie of the group of booties including:

a base layer that has the approximate shape of a foot, wherein the base layer includes a forefoot portion, a heel portion, and a midfoot portion disposed between the forefoot portion and the heel portion, wherein the forefoot portion, heel portion, and midfoot portion together cover a top portion of a wearer's foot, including a wearer's toes, and a heel of the wearer's foot when the bootie is worn by the wearer; and an integrated midsole portion secured to the base layer, wherein the integrated midsole portion is more rigid than the base layer;

wherein each of the booties is configured to be received in the article of footwear; and wherein the integrated midsole portion of each bootie of the group of booties extends from the forefoot portion through the midfoot portion to the heel portion and provides cushioning for a different region of a foot so that the booties may be interchanged with one another to accommodate different athletic activities, wherein a first bootie provides a first targeted cushioning to provide cushioning and shock absorbency for an ankle and the heel of the wearer's foot, the first targeted cushioning disposed on an ankle portion and the heel portion of the first bootie and targeted towards the ankle portion and the heel portion and includes a wrap portion that wraps around and encircles an ankle of the wearer when the wearer's foot is inserted within the first bootie and further wherein the first bootie includes a first support system that includes a plurality of threads collected into a first thread group, wherein the first thread group extends from a medial side of the heel portion of the first bootie upwardly into the ankle portion of the first bootie and around a forward portion of a throat of the first bootie, and wherein a second bootie provides a second targeted cushioning to provide cushioning and shock absorbency for a bottom of the wearer's foot, the second targeted cushioning disposed on an arch portion and the midfoot portion of the second bootie and targeted towards the arch portion and the midfoot portion to support an arch of the wearer's foot when the wearer's foot is inserted within the second bootie.

10. The interchangeable bootie system according to claim 9, wherein the first bootie provides support to the ankle and wherein the second bootie provides support to a midfoot.

11. The interchangeable bootie system according to claim 9, wherein the group of booties further includes a third bootie and wherein the third bootie provides support to a forefoot.

12. The interchangeable bootie system according to claim 9, wherein the first bootie provides support to the ankle and wherein the second bootie provides support to the arch.

13. The interchangeable bootie system according to claim 9, wherein the first bootie provides support to the heel and wherein the second bootie provides support to a midfoot.

14. The interchangeable bootie system according to claim 9, wherein the integrated midsole portion of the first bootie includes at least one cushioning element that provides cushioning to at least the ankle and the heel.

15. The interchangeable bootie system according to claim 14, wherein the integrated midsole portion of the second bootie includes a first cushioning element that provides cushioning to the arch and a second cushioning element that provides cushioning to a midfoot.

16. A kit of parts, comprising:

an article of footwear having an upper and an interior surface;

a first bootie including:

a first base layer that has the approximate shape of a foot, wherein the first base layer includes a forefoot portion, a heel portion, and a midfoot portion disposed between the forefoot portion and the heel portion, wherein the forefoot portion, heel portion, and midfoot portion together cover a top portion of a wearer's foot, including a wearer's toes, and a heel portion of the wearer's foot when the first bootie is worn by the wearer;

a first support system that includes a plurality of threads collected into a first thread group, wherein the first thread group extends from a medial side of the heel portion of the first bootie upwardly into an ankle portion of the first bootie and around a forward portion of a throat of the first bootie; and a first integrated midsole portion extending from the forefoot portion through the midfoot portion to the heel portion and is secured to the first base layer, wherein the first integrated midsole portion is more rigid than the first base layer, wherein the first integrated midsole portion includes a first cushioning element covering a first area of the first integrated midsole portion; wherein the first bootie is configured to be inserted into the article of footwear such that the first integrated midsole portion contacts the interior surface of the article of footwear;

a second bootie including:

a second base layer that has the approximate shape of a foot, wherein the second base layer includes a forefoot portion, a heel portion, and a midfoot portion disposed between the forefoot portion and the heel portion, wherein the forefoot portion, heel portion, and midfoot portion together cover the top portion of a wearer's foot, including the wearer's toes, and a heel portion of the wearer's foot when the second bootie is worn by the wearer; and a second integrated midsole portion extending from the forefoot portion through the midfoot portion to the heel portion and is secured to the second base layer, wherein the second integrated midsole portion is more rigid than the second base layer, wherein the second integrated midsole portion includes a second cushioning element covering a second area of the second integrated midsole portion that is bigger than the first area of the first integrated midsole portion; wherein the second bootie is configured to be inserted into the article of footwear such that the second integrated midsole portion contacts the interior surface of the article of footwear, and further wherein the first cushioning element is different than the second cushioning element; and further wherein the first cushioning element provides a first targeted cushioning to provide cushioning and shock absorbency for an ankle and the heel of the wearer's foot, the first targeted cushioning disposed on the ankle portion and the heel portion of the first bootie and targeted towards the ankle portion and the heel portion and includes a wrap portion that wraps around and encircles an ankle of the wearer when the wearer's foot is inserted within the first bootie, and wherein the second cushioning element provides a second targeted cushioning to provide cushioning and shock absorbency for a bottom of the wearer's foot, the second targeted cushioning disposed on an arch portion and the midfoot portion of the second bootie and targeted towards the arch portion and the midfoot portion to a second portion of the article of footwear to support the arch of the wearer's foot when the wearer's foot is inserted within the second bootie.

17. The kit of parts according to claim 16, wherein the first cushioning element is disposed in at least one of the ankle portion and the heel portion of the article of footwear.

18. The kit of parts according to claim 16, wherein the second cushioning element is disposed in the arch portion of the article of footwear and the second integrated midsole portion includes a third cushioning element that is disposed in the midfoot portion of the article of footwear.

19. The kit of parts according to claim 1, further including:

a third bootie including:

a third base layer that has the approximate shape of a foot, wherein the third base layer includes a forefoot portion, a heel portion, and a midfoot portion disposed between the forefoot portion and the heel portion, wherein the forefoot portion, heel portion, and midfoot portion together cover the top portion of the wearer's foot, including the wearer's toes, and the heel portion of the wearer's foot when the third bootie is worn by the wearer; and a third integrated midsole portion extending from the forefoot portion through the midfoot portion to the heel portion and is secured to the third base layer, wherein the third integrated midsole portion is more rigid than the third base layer, wherein the third bootie is configured to be inserted into the article of footwear;

wherein the third integrated midsole includes a third targeted cushioning system with a third targeted cushioning to provide cushioning and shock absorbency for the bottom of the wearer's foot, the third targeted cushioning disposed on the forefoot portion and the midfoot portion of the third bootie and targeted towards the forefoot portion to support a forefoot of the wearer's foot when the wearer's foot is inserted within the third bootie.

20. The interchangeable bootie system according to claim 9, wherein a third bootie provides a third targeted cushioning to provide cushioning and shock absorbency for the bottom of the wearer's foot, the third targeted cushioning disposed on the forefoot portion and the midfoot portion of the third bootie and targeted towards the forefoot portion to support a forefoot of the wearer's foot when the wearer's foot is inserted within the third bootie.

21. The kit of parts according to claim 16, further including:

a third bootie including:

a third base layer that has the approximate shape of a foot, wherein the third base layer includes a forefoot portion, a heel portion, and a midfoot portion disposed between the forefoot portion and the heel portion, wherein the forefoot portion, heel portion, and midfoot portion together cover the top portion of a wearer's foot, including the wearer's toes, and a heel portion of the wearer's foot when the second bootie is worn by the wearer; and a third integrated midsole portion extending from the forefoot portion through the midfoot portion to the heel portion and is secured to the third base layer, wherein the third integrated midsole portion is more rigid than the third base layer, wherein the third integrated midsole portion includes a third cushioning element;

wherein the third bootie is configured to be inserted into the article of footwear such that the third integrated midsole portion contacts the interior surface of the article of footwear; and wherein the third cushioning element provides a third targeted cushioning to provide cushioning and shock absorbency for the bottom of the wearer's foot, the third targeted cushioning disposed on the forefoot portion and the midfoot portion of the third bootie and targeted towards the forefoot portion to support a forefoot of the wearer's foot when the wearer's foot is inserted within the third bootie.

22. The kit of parts according to claim 1, wherein one or more of the first bootie and the second bootie includes a gripping layer located on a bottom surface of the bootie to provide traction for the bootie when inserted within the article of footwear.

23. The kit of parts according to claim 22, wherein the gripping layer comprises a plurality of textured elements on the bottom surface.

24. The kit of parts according to claim 9, wherein one or more of the group of booties includes a gripping layer located on a bottom surface of the bootie to provide traction for the bootie when inserted within the article of footwear.

25. The kit of parts according to claim 24, wherein the gripping layer comprises a plurality of textured elements on the bottom surface.

26. The kit of parts according to claim 16, wherein one or more of the first bootie and the second bootie includes a gripping layer located on a bottom surface of the bootie to provide traction for the bootie when inserted within the article of footwear.

27. The kit of parts according to claim 26, wherein the gripping layer comprises a plurality of textured elements on the bottom surface.

* * * * *